US012201252B2

(12) United States Patent
Pruiett

(10) Patent No.: US 12,201,252 B2
(45) Date of Patent: Jan. 21, 2025

(54) VACUUM CLEANER ACCESSORY TOOL

(71) Applicant: BISSELL INC., Grand Rapids, MI (US)

(72) Inventor: Jason W. Pruiett, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 23 days.

(21) Appl. No.: 18/167,435

(22) Filed: Feb. 10, 2023

(65) Prior Publication Data

US 2023/0180989 A1 Jun. 15, 2023

Related U.S. Application Data

(63) Continuation of application No. 16/937,123, filed on Jul. 23, 2020, now Pat. No. 11,607,101.

(60) Provisional application No. 62/882,779, filed on Aug. 5, 2019.

(51) Int. Cl.
*A47L 11/40* (2006.01)
*A47L 9/02* (2006.01)

(52) U.S. Cl.
CPC ..... *A47L 11/4044* (2013.01); *A47L 9/02* (2013.01)

(58) Field of Classification Search
CPC ..... A47L 5/12; A47L 5/28; A47L 7/00; A47L 7/0066; A47L 9/02; A47L 9/04; A47L 9/06; A47L 9/248; A47L 9/0613; A47L 9/066; A47L 9/0018; A47L 9/009; A47L 9/0009; A47L 9/0472; A47L 11/4044; B25B 27/0028; B25B 27/0035; B25B 27/0023; B25B 27/06; Y10T 29/53657; Y10T 29/53796; Y10T 29/53848; Y10T 29/53878
See application file for complete search history.

(56) References Cited

U.S. PATENT DOCUMENTS

| | | | | |
|---|---|---|---|---|
| 3,745,605 | A | 7/1973 | Gitschel et al. | |
| 3,820,189 | A | 6/1974 | Roth | |
| 4,888,852 | A | 12/1989 | Varin | |
| 5,187,834 | A | 2/1993 | Stark | |
| 7,254,866 | B2 | 8/2007 | Francoeur | |
| 8,677,544 | B1 | 3/2014 | Raven et al. | |
| 2004/0221419 | A1 | 11/2004 | Francoeur | |
| 2005/0076468 | A1* | 4/2005 | Matousek | A47L 13/256 15/403 |
| 2010/0229339 | A1* | 9/2010 | Lambourn | A47L 9/02 15/415.1 |

(Continued)

FOREIGN PATENT DOCUMENTS

| | | | |
|---|---|---|---|
| CN | 101310663 | A | 11/2008 |
| CN | 101778699 | A | 7/2010 |

(Continued)

OTHER PUBLICATIONS

Speedfit Technology, push-fit design, 2019m https://yacf.co.uk/forum/index.php?topic=110991.0 (Year: 2019).

*Primary Examiner* — Robert J Scruggs
(74) *Attorney, Agent, or Firm* — McGarry Bair PC

(57) ABSTRACT

An accessory tool for use with a vacuum cleaner. The accessory tool has a hair removal system configured to collect hair from various surfaces to be cleaned, including soft surfaces such as upholstery, dog beds, pillows, and automobile interiors. The collected hair is gathered by the hair removal system and ingested via the vacuum cleaner.

20 Claims, 26 Drawing Sheets

(56) References Cited

U.S. PATENT DOCUMENTS

| | | | | |
|---|---|---|---|---|
| 2012/0110775 | A1 | 5/2012 | Krebs | |
| 2017/0049283 | A1 * | 2/2017 | Sørrig Dodt | A47L 9/0613 |

FOREIGN PATENT DOCUMENTS

| | | | | |
|---|---|---|---|---|
| CN | 103349529 | A | | 10/2013 |
| DE | 1059635 | | * | 6/1959 |
| DE | 1144889 | | * | 3/1963 |
| DE | 1144889 | B | | 3/1963 |
| EP | 1449473 | A2 | | 8/2004 |
| GB | 2150014 | A | | 6/1985 |
| GB | 2470444 | | * | 11/2010 |
| JP | 2012228376 | A1 | | 11/2012 |

* cited by examiner

VACUUM CLEANER ACCESSORY TOOL

CROSS-REFERENCE TO RELATED APPLICATION(S)

This application is a continuation of U.S. patent application Ser. No. 16/937,123, filed Jul. 23, 2020, now U.S. Pat. No. 11,607,101, which claims the benefit of U.S. Provisional Patent Application No. 62/882,779, filed Aug. 5, 2019, both of which are incorporated herein by reference in their entireties.

BACKGROUND

Vacuum cleaners are known for removing dry or wet debris from surfaces, including fabric-covered surfaces like carpets and upholstery, and bare surfaces like hardwood, linoleum, vinyl, and tile, and contain a suction source for generating a vacuum force at the surface to remove debris. Pet hair from shedding animals, such as dogs and cats, can easily get trapped in fabrics, such as carpets, rugs, upholstered furniture, and other similar items. While a vacuum cleaner can suction up some of the hair, a good portion of the hair can become trapped within the fibers of the fabric such that the vacuum cleaner alone cannot suction up the hair. Vacuum cleaners also have similar problems suctioning up other small debris.

BRIEF DESCRIPTION

An aspect of the present disclosure relates to an accessory tool, comprising a housing assembly defining an underside, a suction nozzle provided at an interior portion of the underside, the housing assembly further comprising an outlet adapted to be connected to a suction source remote from the housing assembly, the suction source adapted for generating a working air flow from the suction nozzle through the housing assembly to the outlet, and a set of channels formed in the underside and extending from the suction nozzle, and a set of hair collecting elements provided on the underside adjacent the set of channels, the set of hair collecting elements configured to create a balling or aggregating effect of removed hair from a surface to be cleaned during use to agglomerate the removed hair into a ball-shaped cluster and move the removed hair towards the set of channels and the suction nozzle.

Another aspect of the present disclosure includes an accessory tool, comprising a housing assembly defining an underside, wherein the housing assembly comprises an upper housing having at least a portion adapted to be held by a user and a lower housing movably coupled to the upper housing and configured for free movement against a surface to be cleaned when the at least a portion of the upper housing is held by the user, a suction nozzle provided at an interior portion of the underside, an outlet provided with the housing assembly and adapted to be connected to a suction source remote from the housing assembly, the suction source adapted for generating a working air flow from the suction nozzle through the housing assembly to the outlet, a set of channels formed in the underside and extending from the suction nozzle, and a set of hair collecting elements provided on the underside adjacent the set of channels, the set of hair collecting elements configured to create a balling or aggregating effect of removed hair from a surface to be cleaned during use to agglomerate the removed hair into a ball-shaped cluster and move the removed hair towards the suction nozzle via the set of channels.

DETAILED DESCRIPTION

Aspects of the present disclosure generally relate to features and improvements for vacuum cleaner accessory tools. Pet hair can pose a challenge to dry and wet vacuum cleaners, as pet hair can embed in and cling to carpets and upholstery in ways that make it difficult to remove. While a traditional vacuum cleaner can remove some of the hair, it is common for much of the hair to become embedded and trapped within the fibers of the fabric thereby preventing effective and complete removal by vacuum cleaner suction alone. Aspects of the present disclosure generally relate to features and improvements for vacuum cleaner accessory tools that remove pet hair and collect pet hair. Further features and improvements relate to an improved vacuum cleaner accessory tool adapted to clean pet beds and other soft surfaces which may collect pet hair including upholstery, pillows, automobile interiors, etc.

Figure 1:
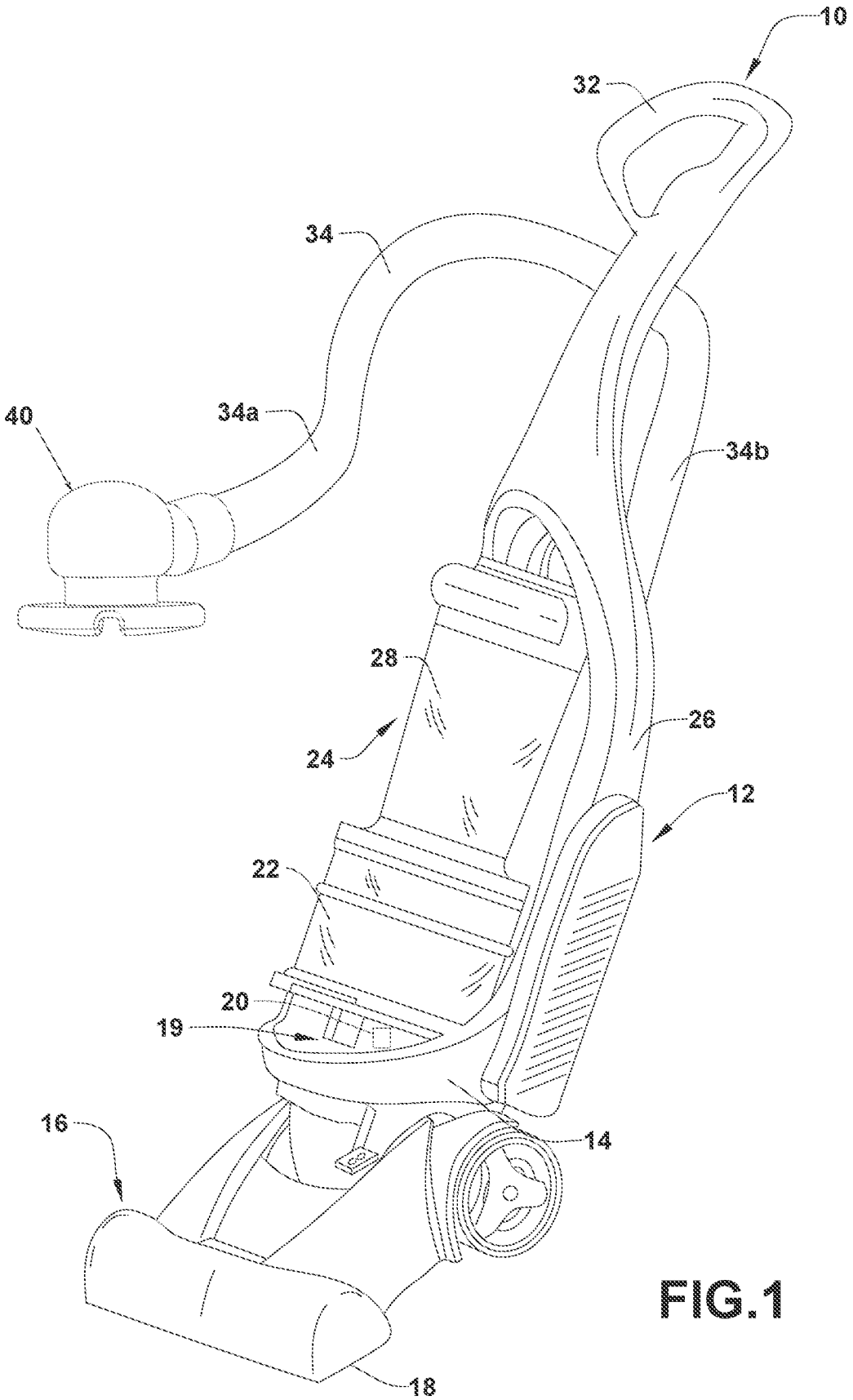
FIG. 1 is a perspective view of vacuum cleaner operably coupled with a vacuum cleaner accessory tool according to various aspects described herein.

FIG. 1 illustrates an accessory tool 40 according to an aspect of the present disclosure operably coupled with an exemplary vacuum cleaner 10, which is shown for purposes of illustration as a "dry" vacuum cleaner 10. Details of a suitable vacuum cleaner 10 for use with the accessory tool 40 are disclosed in commonly assigned U.S. Pat. No. 6,810,557 to Hansen et al. and U.S. Pat. No. 7,188,388 to Best et al., which are incorporated herein by reference in their entirety. As used herein, the term "dry" vacuum cleaner is used to denote a vacuum cleaner that is not capable of fluid distribution or fluid recovery without the accessory tool, and may include, but is not limited to, upright, canister, stick-type, or hand-held vacuum cleaners, vacuum cleaners which are convertible between one or more of these types, or a built-in central vacuum cleaning system. As used herein, the term "wet" vacuum cleaner is used to denote a vacuum cleaner that is capable of at least one of fluid distribution (liquid or steam) or fluid recovery with or without the accessory tool, and can be capable of both fluid distribution or fluid recovery with or without the accessory tool and may include, but are not limited to, vacuum mops, extractors and carpet cleaners, including upright, canister, stick-type, or hand-held vacuum cleaners, vacuum cleaners which are convertible between one or more of these types, or a built-in central vacuum cleaning system. Further, the vacuum cleaner used with the accessory tool(s) described herein can be adapted to clean fabric-covered surfaces, such as carpets and upholstery, or bare surfaces, such as hardwood, linoleum, and tile.

The vacuum cleaner 10 illustrated is an upright-type vacuum cleaner 10 with an upright assembly 12 that can include a housing 14 pivotally mounted to a foot assembly or base 16. The upright assembly 12 further includes a primary support section 26 with a grip 32 on one end to facilitate movement by a user. A suction source housing 19 is formed at an opposite end of the upright assembly 12 to contain a suction source 20, which may be a vacuum fan/motor assembly, and which is configured to generate a working airstream through a working air path of the vacuum cleaner 10 that extends from a "dirty" air inlet to a "clean" air outlet. The suction source 20 can form a portion of the working air path. Furthermore, the base 16 includes a suction nozzle 18 that is in fluid communication with the suction source 20.

The primary support section 26 receives a separating and collection assembly 24 for separating debris and other contaminants from the working airstream. The separating and collection assembly 24 is illustrated herein as including a cyclone module having a cyclone separator 28 for separating entrained debris from the working airstream and a collection chamber 22 for collecting the separated debris. The cyclone separator 28 can have a single cyclonic separation stage, or multiple stages. It is understood that other types of dirt separating and collection assemblies can be used, such as centrifugal separators or bulk separators. In yet another conventional arrangement, the filtration system can include a filter bag. Regardless of its particular configuration, the filtration system can form a portion of the working air path through the vacuum cleaner 10. Additional filters may be provided in the filtration system, including pre- and post-motor filters.

At least a portion of the working air path leading to the separating and collection assembly 24 can be formed by a vacuum hose 34. An accessory tool 40 is configured to be operably coupled with the vacuum cleaner 10 and can in particular be coupled with the vacuum hose 34 in fluid communication with the suction source 20 carried by a housing 14 of the vacuum cleaner 10. For example, one end 34*a* of the vacuum hose 34 can be selectively disconnected from the vacuum cleaner 10 and connected to the accessory tool 40 for cleaning using the accessory tool 40, as shown in FIG. 1, while the other end 34*b* remains in fluid communication with the separating and collection assembly 24. When the accessory tool 40 is in use and the end 34*a* of the vacuum hose 34 is coupled with the accessory tool 40, the accessory tool 40 can form the "dirty" air inlet. Thus, the vacuum cleaner 10 can draw in dirt-laden air through the accessory tool 40 and the hose 34 and into the filtration system, such as the separating and collection assembly 24, where the dirt is trapped for later disposal. When the accessory tool 40 is not in use, and both ends 34*a*, 34*b* of the vacuum hose 34 are connected with the vacuum cleaner 10, which can include the ends 34*a*, 34*b* coupled to the base 16, the suction nozzle 18 can form the "dirty" air inlet. Alternatively, the accessory tool 40 can be selectively connectable to a wand (such as illustrated in 4A) that is coupled with the vacuum hose 34 rather than directly to the vacuum hose 34.

For purposes of description related to the figures, the terms "upper," "lower," "right," "left," "rear," "front," "vertical," "horizontal," "inner," "outer," and derivatives thereof shall relate to the present disclosure as oriented in FIG. 1. However, it is to be understood that the disclosure may assume various alternative orientations, except where expressly specified to the contrary.

Figure 2A:
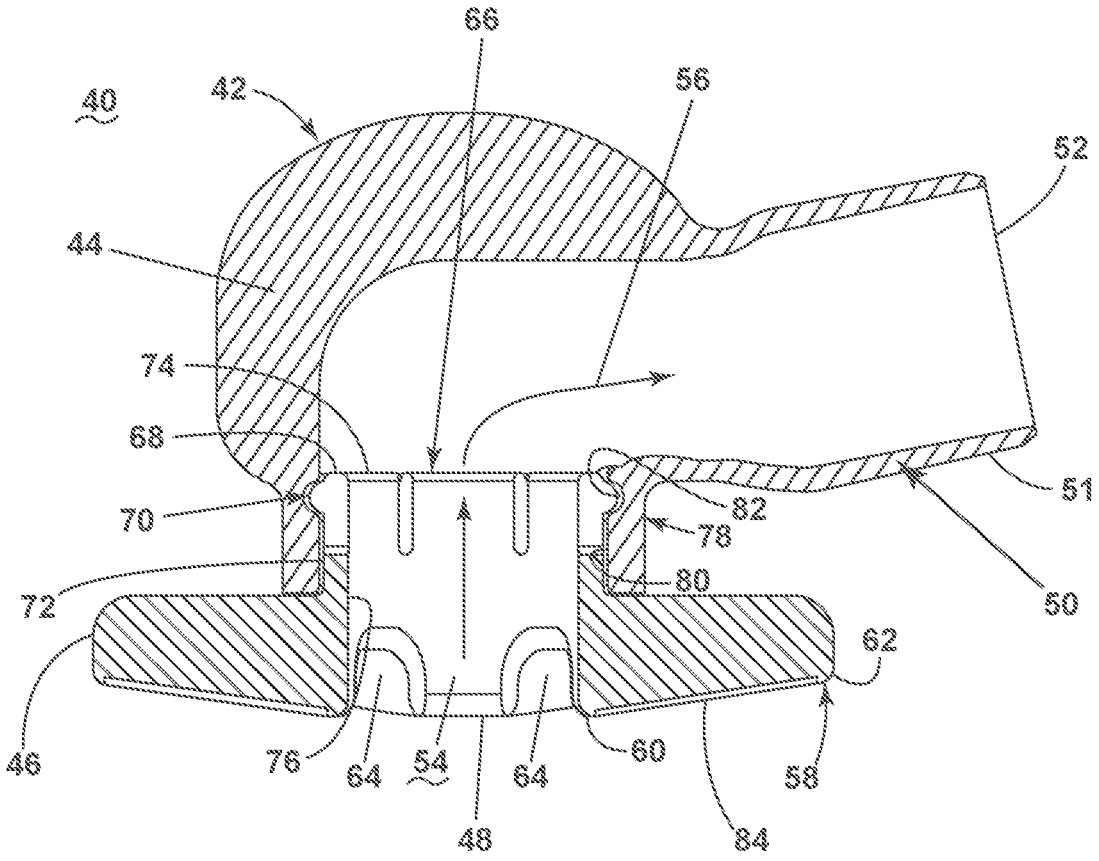
FIG. 2A is a cross-sectional view of the vacuum cleaner accessory tool of FIG. 1.

FIG. 2A illustrates the accessory tool 40 in more detail. A main housing assembly 42 of the accessory tool 40 is collectively formed by an upper housing 44 and a lower housing 46, a suction nozzle 48 is formed at an underside of the main housing assembly 42. It will be understood that while the accessory tool 40 is shown as having a two-part main housing assembly 42, the accessory tool 40 can be formed in any suitable manner including have a single main housing or a multi-piece main housing that is secured together.

A hose attachment 50 can be integral with the main housing assembly 42. The hose attachment 50 can include a body such as a conduit 51 with an outlet 52. In the illustrated example, the conduit 51 is integrally formed with the upper housing 44. However, it will be understood that the conduit 51 can alternatively be formed, mounted, or operably coupled to the upper housing 44 in any suitable manner. The conduit 51 defined by the hose attachment 50 is at a slight inclined angle from a body forming the upper housing 44 although it will be understood that this need not be the case. The hose attachment 50 can be configured to be operably coupled with the vacuum hose 34 on the vacuum cleaner 10 (FIG. 1) such that a fluid coupling can be created via the outlet 52. The conduit 51 can also be utilized by a user to hold, or grasp, the accessory tool 40 and direct its movement across a surface to be cleaned. Alternatively, or additionally, an upper portion of the upper housing 44 or other portions of the main housing assembly 42 can be held by a user.

The suction nozzle 48 can be defined by a suction nozzle inlet 54 located in the lower housing 46. When the accessory tool 40 is coupled with the vacuum cleaner 10, the suction nozzle inlet 54 of the accessory tool 40 can form the "dirty" air inlet. A working airflow can be drawn through an airflow pathway 56, partially illustrated with arrows, of the accessory tool 40 defined in the main housing assembly 42 from the suction nozzle inlet 54 to the outlet 52.

The lower housing 46 is illustrated as having a domed underside 58. The domed underside 58 has a profile having a distal most extension 60 at the suction nozzle inlet 54. The distal most extension 60 is the furthest or most extended point of the domed underside 58 and effectively forms a shoulder about the suction nozzle inlet 54. The domed underside 58 extends in an inclined or a sloped manner from the distal most extension 60 to an outer periphery 62 of the domed underside 58 when the domed underside 58 is oriented downward. The outer periphery 62 would be further from a surface to be cleaned than the distal most extension 60 when the domed underside 58 is adjacent the surface to be cleaned. While the term "domed underside" has been utilized it can be understood that the profile, geometry, or shape of the underside can be arced, a flat incline, or any suitable profile creating the shouldered effect around the suction nozzle inlet 54.

A set of channels 64 are formed in the domed underside 58. As used herein "a set" can include any number of the respectively described elements, including only one element. In the illustrated example, multiple channels are included in the set of channels 64.

A first conduit portion 66 forms a portion of the lower housing 46 and projects away from a body forming the domed underside 58, the first conduit portion 66 terminates at a first end 68. A detent or flange 70 is located about an exterior surface 72 of the first conduit portion 66 proximate the first end 68. In the illustrated example, flexible fingers 74 form the first end 68 of the first conduit portion 66 and the flange 70 is formed thereon. The flexible fingers 74 can be spaced (as illustrated) or be directly adjacent each other. An interior 76 of the first conduit portion 66 forms a portion of the flow path generally illustrated by arrows 56.

A second conduit portion 78 extends from the upper housing 44 and is sized to receive the first conduit portion 66. More specifically, an interior 80 of the second conduit portion 78 is larger in size than the exterior surface 72 of the first conduit portion 66. Further still, a channel, catch, or recess 82 can be formed within the interior 80. The recess 82 can have a complementary profile shape, profile, or geometry to the flange 70, as illustrated, or be configured in any suitable manner so as to moveably retain the flange 70. More specifically, the recess 82 can be adapted to retain the flange 70 axially and allow for rotatable movement of the first conduit portion 66 within the second conduit portion 78. In this manner, a sliding bearing can be formed by the first conduit portion 66 within the second conduit portion 78.

Further still, it is contemplated that at least one of the first conduit portion 66 or the second conduit portion 78 can be adapted such that rotation of the first conduit portion 66 within the second conduit portion 78 is indexed instead of having the first conduit portion 66 freely rotatable within the second conduit portion 78. In such an instance, the recess 82 may be formed as a series of discreet recesses 82 about the interior 80 of the second conduit portion 78 and the flange 70 located on the fingers 74 can be rotated in one or more directions to each indexable position formed via interaction of the fingers 74 and recesses 82. Further, while the first conduit portion 66 has been described as including the flange 70 and being retained within the second conduit portion 78 having the recess 82 it will be understood that they could be formed and arranged such that the second conduit portion includes the flanged portion and is received within the first conduit having a recess therein.

First debris or lint and hair collecting elements, referred to herein as first hair collecting elements 84 are located on the underside of the main housing assembly 42. As illustrated more clearly in FIG. 2B, the first hair collecting elements 84 include generally semi-circular-shaped pieces of conventional directional fabric that are fastened to the domed underside 58, oriented about the suction nozzle inlet 54. While four separate first hair collecting elements 84 are illustrated, it will be understood that any suitable number and orientation can be utilized. Two of the first hair collecting elements 84 are illustrated side by side and spaced apart by the suction nozzle inlet 54 there between. The remaining two of the first hair collecting elements 84 are illustrated top and bottom and spaced apart by the suction nozzle inlet 54 there between. All of the first hair collecting elements 84 are radially spaced apart from each other via the set of channels 64, which extend from the suction nozzle inlet 54 to the outer periphery 62.

The first hair collecting elements 84 can be fastened or mounted to the domed underside 58 of the lower housing 46 in any suitable manner. By way of non-limiting example, the first hair collecting elements 84 can be sewn to the domed underside 58 or otherwise fastened via suitable means such as fabric adhesive or fuse bonding, for example. Each of the first hair collecting elements 84 includes directional fabric having unidirectional oriented fibers 86, respectively. The unidirectional oriented fibers 86 have been illustrated as small arrows indicating the direction of orientation of unidirectional oriented fibers 86 for the purposes of discussion. It will be understood that the term unidirectional oriented fibers refers to a group of fibers in which a majority of the fibers have the same general alignment and the same general orientation and further that there may be some variation in the alignment and orientation of the fibers naturally and/or due to manufacturing processes.

The directional fabric of the first hair collecting elements 84 can include a 450 denier base polyester material with unidirectional polyester oriented fibers having a fluff height of 1.3-1.7 mm. A denier is a term used in the textile industry and refers to the unit of linear mass density of fibers, defined as the mass in grams per 9,000 meters. The fabric weight is preferably 450-500 grams per square meter, although additional weights are also suitable depending upon the desired flexibility. An example of a suitable directional fabric is commercially available from Ju Rong Shi Xin Cai Gong Yi Zhi Zao Chang as "Type C" lint fabric. Alternatively, the directional fabric can include other fabric types such as velour or other fabrics that include cut or uncut loops of fibers, such as natural fibers, synthetic fibers, glass fibers, thread, or wool provided that a majority of the fibers are oriented or tilted in one direction. Each of the first hair collecting elements 84 is oriented inwardly so that the unidirectional oriented fibers 86 are effective at guiding debris towards the set of channels 64 and suction nozzle inlet 54 when the accessory tool 40 is moved against the surface to be cleaned. Accordingly, the unidirectional oriented fibers 86 of the first hair collecting elements 84 oppose each other and are both oriented inwardly towards the set of channels 64 and suction nozzle inlet 54.

The accessory tool 40 when mounted to a suction source, including a cleaning apparatus, shown in FIG. 1 can be used to effectively remove debris including hair from the surface to be cleaned in accordance with the following method. The sequence discussed is for illustrative purposes only and is not meant to limit the method in any way as it is understood that the steps may proceed in a different logical order, additional or intervening steps may be included, or described steps may be divided into multiple steps, without detracting from the present disclosure.

Figure 2B:
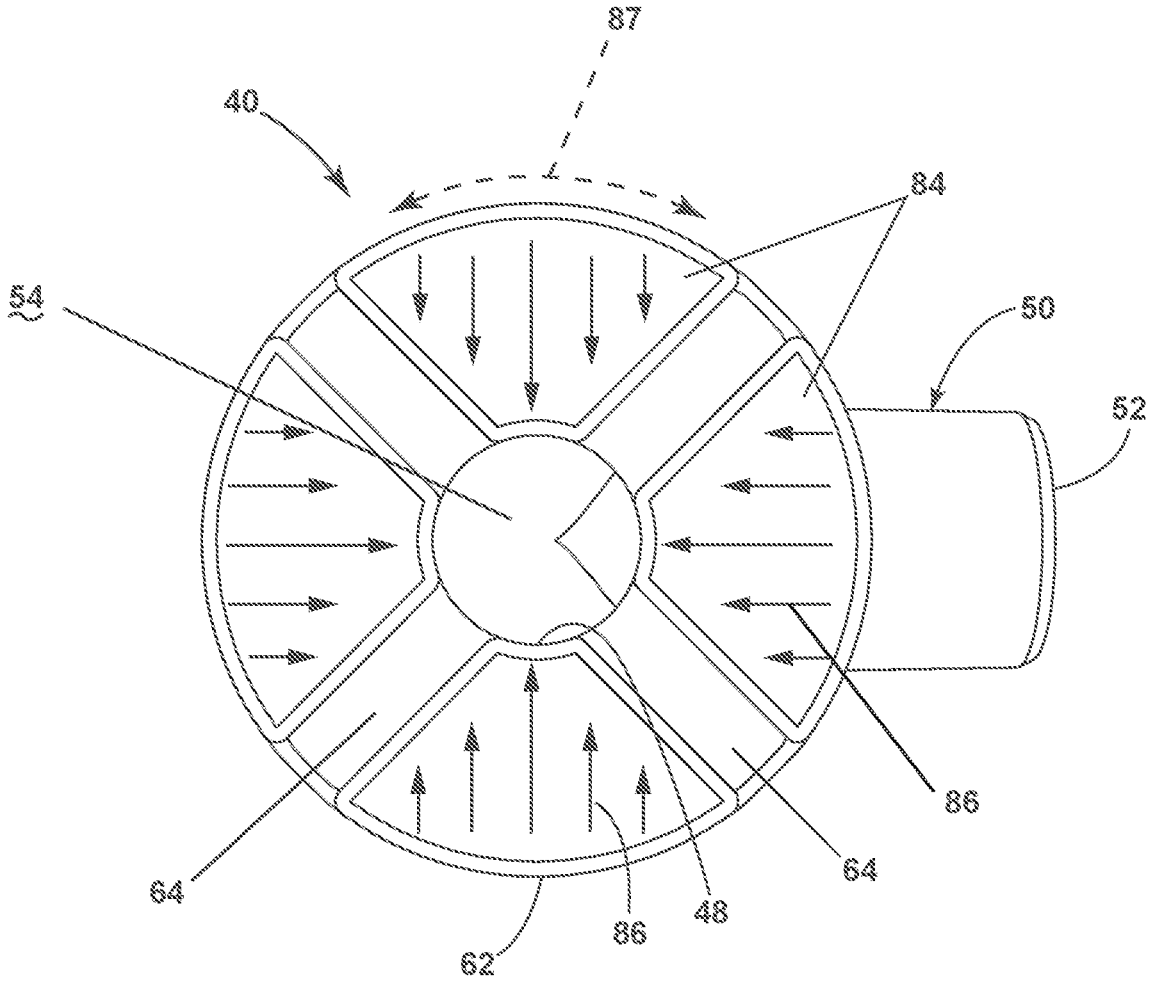
FIG. 2B is a bottom view of the vacuum cleaner accessory tool of FIG. 1.

Referring to both FIG. 2A and FIG. 2B, during operation, suction source can be provided via the cleaning apparatus such as the vacuum cleaner 10 and the airflow pathway 56 can be configured such that air can flow in a rearward direction from the suction nozzle inlet 54 to the outlet 52 and to the connected vacuum cleaner 10 (FIG. 1). The airflow pathway 56 can be at least partially defined by the interior 76 of the first conduit portion 66 and the conduit 51 leading to the outlet 52. A user can grip the accessory tool 40 at any suitable location including the conduit 51 or a portion of the main housing assembly 42 and presses the domed underside 58 and associated first hair collecting elements 84 against the surface to be cleaned. Next, the user wipes the accessory tool 40 across the surface to be cleaned.

It will be understood that the accessory tool 40 can be utilized in a variety of manners including movement along a left-right stroke, top-bottom stroke. Left-right strokes are similar to top-bottom strokes so only the left-right stroke will be described herein with it being understood that the top-bottom stroke works in a similar modality. In the left-right stroke use, the user may first move the accessory tool 40 in a left cleaning stroke along the surface to be cleaned to the left of the user, followed by a right cleaning stroke to the right of the user in the opposite direction. It is envisioned that the user continues to wipe the accessory tool 40 across the surface using any combination of alternating and/or repeated cleaning strokes, left or right.

A left stroke is with the lay of the unidirectional oriented fibers 86 on the one of the side-by-side first hair collecting elements 84, meaning that a left stroke tends to push the unidirectional oriented fibers 86 downwardly and inwardly towards the center of the domed underside 58 or the suction nozzle inlet 54. Conversely, a left stroke is against the lay of the unidirectional oriented fibers 86 on the other of the side-by-side first hair collecting elements 84. Accordingly, on the left stroke, the unidirectional oriented fibers 86 of the other of the side-by-side first hair collecting elements 84 may tend to raise the nap on the surface being cleaned of any fibers that may be generally oriented in the opposite direction of the unidirectional oriented fibers 86, and remove and collect lint, hair and other debris therefrom.

A right cleaning stroke is with the lay of the unidirectional oriented fibers 86 on the other of the side-by-side first hair collecting elements 84 and against the lay of the unidirectional oriented fibers 86 on the one of the side-by-side first hair collecting elements 84. Accordingly, when the accessory tool 40 is wiped along a right cleaning stroke, the unidirectional oriented fibers 86 of the other of the side-by-side first hair collecting elements 84 are pushed downwardly and inwardly towards the center of the domed underside 58 or the suction nozzle inlet 54. Moreover, the unidirectional oriented fibers 86 of the other of the side-by-side first hair collecting elements 84 tend to release any previously collected lint, hair and debris as the accessory tool 40 is moved in a right cleaning stroke. Conversely, the opposing unidirectional oriented fibers 86 of the one of the side-by-side first hair collecting elements 84 tend to raise the nap of any fibers on the surface to be cleaned that may be generally oriented in the opposite direction of the unidirectional oriented fibers 86, and remove and collect lint, hair and other debris therefrom.

While the method of use of the accessory tool 40 is described with respect to alternating left and right strokes, it will be understood that multiple strokes in a single direction can be completed before alternating to one or more strokes in the opposite direction. In addition, it will be understood that the accessory tool 40 can be used on a surface having a unidirectional nap or a non-unidirectional nap in a similar manner. Additionally, the user can wipe in a top-bottom motion, which will work similarly to the left-right motion as just described. Even further still, the accessory tool 40 can be moved in a rotational or circular motion.

It will be understood that regardless of the stroke or motion made by a hand of the user holding the accessory tool that the lower housing 46 is free to rotate as indicated by the arrow 87. More specifically, the lower housing 46, which is rotatably coupled to the upper housing 44 can be caused by friction to rotate when a user drags, pushes, or otherwise moves the domed underside 58 against the surface to be cleaned. In this manner, movement of the lower housing 46 against the surface to be cleaned may cause the first conduit portion 66 to turn within the second conduit portion 78 such that the lower housing 46 rotates, partially rotates, or pivots with use by the user. It will be understood that the lower housing 46 is free to rotate in a full or partial rotational stroke in either a clockwise or counter-clockwise direction.

Unlike conventional tools that accumulate and hold debris, the accessory tool 40 during operation balls-up debris for easy ingestion through the suction nozzle inlet 54. Specifically, first hair collection elements 84 of the accessory tool 40 tend to self-clean during operation. Thus, the accessory tool 40 provides improved hair removal from upholstery and other soft surfaces to be cleaned. During operation, the movement and free rotation of the lower housing 46 allows the lint, hair and other debris, which have been liberated from the surface to be cleaned by the unidirectional oriented fibers 86 of the first hair collecting elements 84 to be released from the unidirectional oriented fibers 86 and collected, balled, rolled together, or otherwise aggregated. The aggregated hair tends to move towards the set of channels 64 and suction nozzle inlet 54 when the cleaning stroke is again switched from the right stroke to the left stroke and is removed via suction from the accessory tool 40. Accordingly, as the user wipes the accessory tool 40 along either in alternating left and right cleaning strokes or with additional or alternative movements, lint, hair, and other debris are removed from the surface, aggregated off the accessory tool automatically and removed via suction within the set of channels 64 and suction nozzle inlet 54.

The described placement and orientation of the first hair collecting elements 84 about the suction nozzle inlet 54 allows the fabric segments and their unidirectional oriented fibers 86 to be oriented so the fibers point inwardly toward the suction nozzle inlet and spaced apart via the set of channels 64. The free rotation of the lower housing 46 relative to the hose attachment 50 combined with the number and orientation of the first hair collecting elements 84 causes hair on the soft surface to be cleaned to ball up and migrate towards the center of the accessory tool 40 for easy ingestion through the suction nozzle inlet 54, which is centralized on the domed underside 58. More specifically, the first hair collection elements 84 liberate, collect, ball up or accumulate, and then release hair to ultimately be ingested by the accessory tool 40 and the vacuum cleaner 10.

Figure 3A:
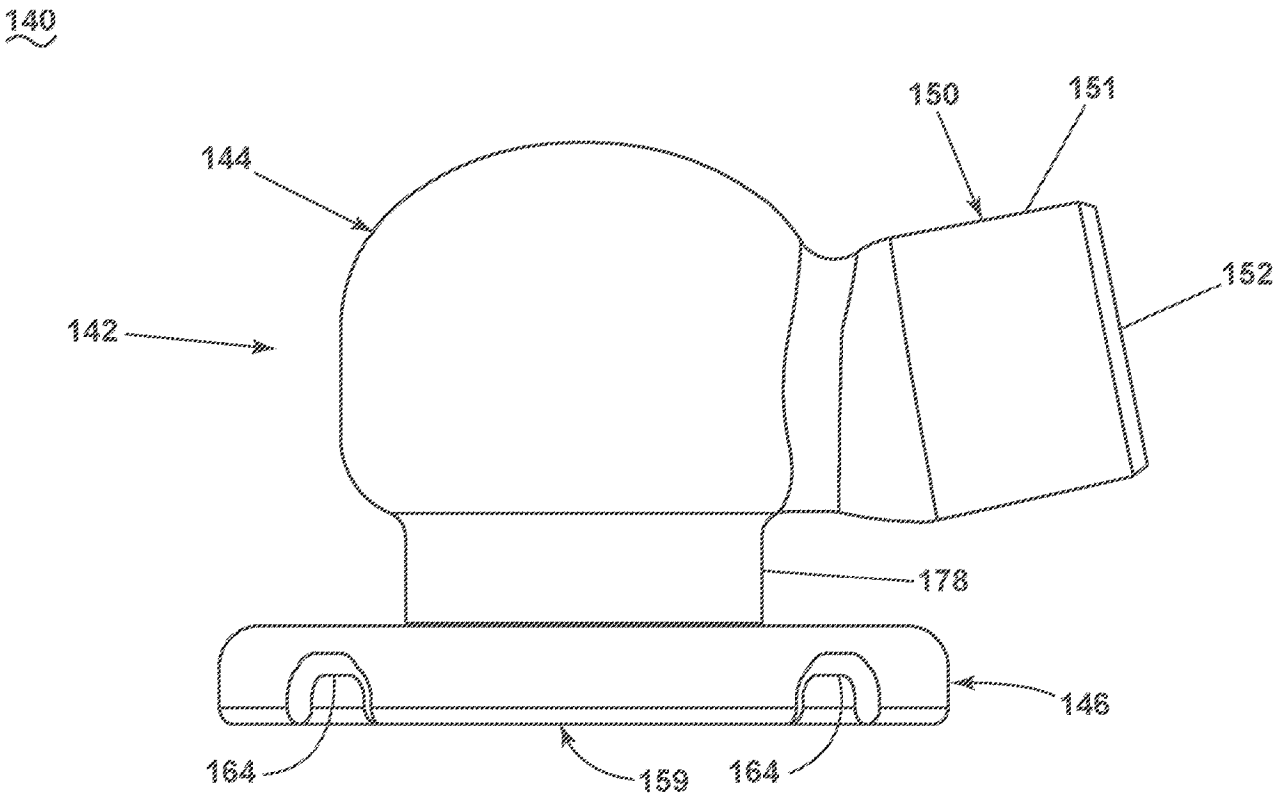
FIG. 3A is a side perspective view of a vacuum cleaner accessory tool that can be utilized with the vacuum cleaner of FIG. 1 according to various aspects described herein.
Figure 3B:
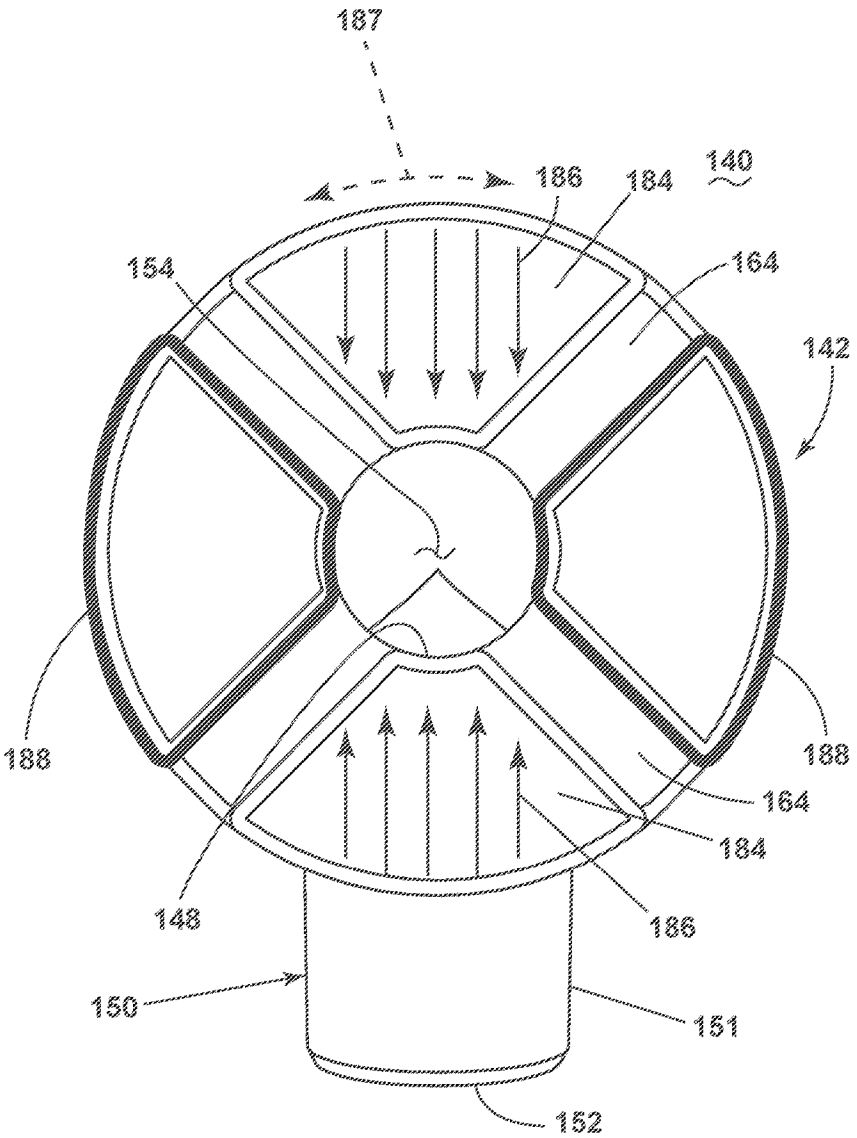
FIG. 3B is a bottom perspective view of the vacuum cleaner accessory tool of FIG. 3A.

FIGS. 3A and 3B illustrate an accessory tool 140 according to another aspect of the present disclosure and includes similar components as described for the accessory tool 40. Therefore, like parts will be identified with like numerals increased by 100, with it being understood that the description of the like parts applies to the accessory tool 140, unless otherwise noted.

One difference is that the accessory tool 140 includes an underside 159 that is generally flat instead of domed. The underside 159 still includes the profile changes for the suction nozzle inlet 154 at its center and the set of channels 164 but is otherwise generally flat.

Further still, as better seen in the bottom view in FIG. 3B, while the accessory tool 140 is illustrated as including first hair collecting elements 184 it can be seen that only two first hair collecting elements 184 have been illustrated instead of four. The two first hair collecting elements 184 can be located side-by-side or top-and-bottom. Alternating with the first hair collecting elements 184 about the suction nozzle inlet 154 and spaced by the set of channels 164 are second hair collecting elements 188. The second hair collecting elements 188 can include, by way of non-limiting example, alternative hair collecting material such as elastomeric material for removing hair from the surface to be cleaned. Some examples of suitable elastomeric materials include thermoplastic polyurethane (TPU), thermoplastic elastomer (TPE), and silicone. It will be understood that the second hair collecting elements 188 can be formed in any suitable manner including that they can include soft elastomeric material with nubs or other features (not shown) that will not damage furniture or other obstacles it contacts. The second hair collecting elements 188 can be mounted or otherwise coated onto the underside 159 in any suitable manner. For example, the second hair collecting elements 188 can be bonded to the underside by a variety of conventional attachment means such as adhesive, overmolding, or mechanical engagement.

The accessory tool 140 operates in the same manner as described above for the accessory tool 40 including having a rotational lower housing, as illustrated by arrow 187, adapted to create a twisting and balling or accumulation of the removed hair such that the aggregated hair is moved towards the suction nozzle inlet 154 and removed during use. The accessory tool 140 combines the second hair collecting elements 188, which grab stubborn hairs but may not self-clean well with the self-cleaning oriented fibers 186 of the first hair collecting elements 184, which can be less effective on deeply embedded hair.

Figure 4A:
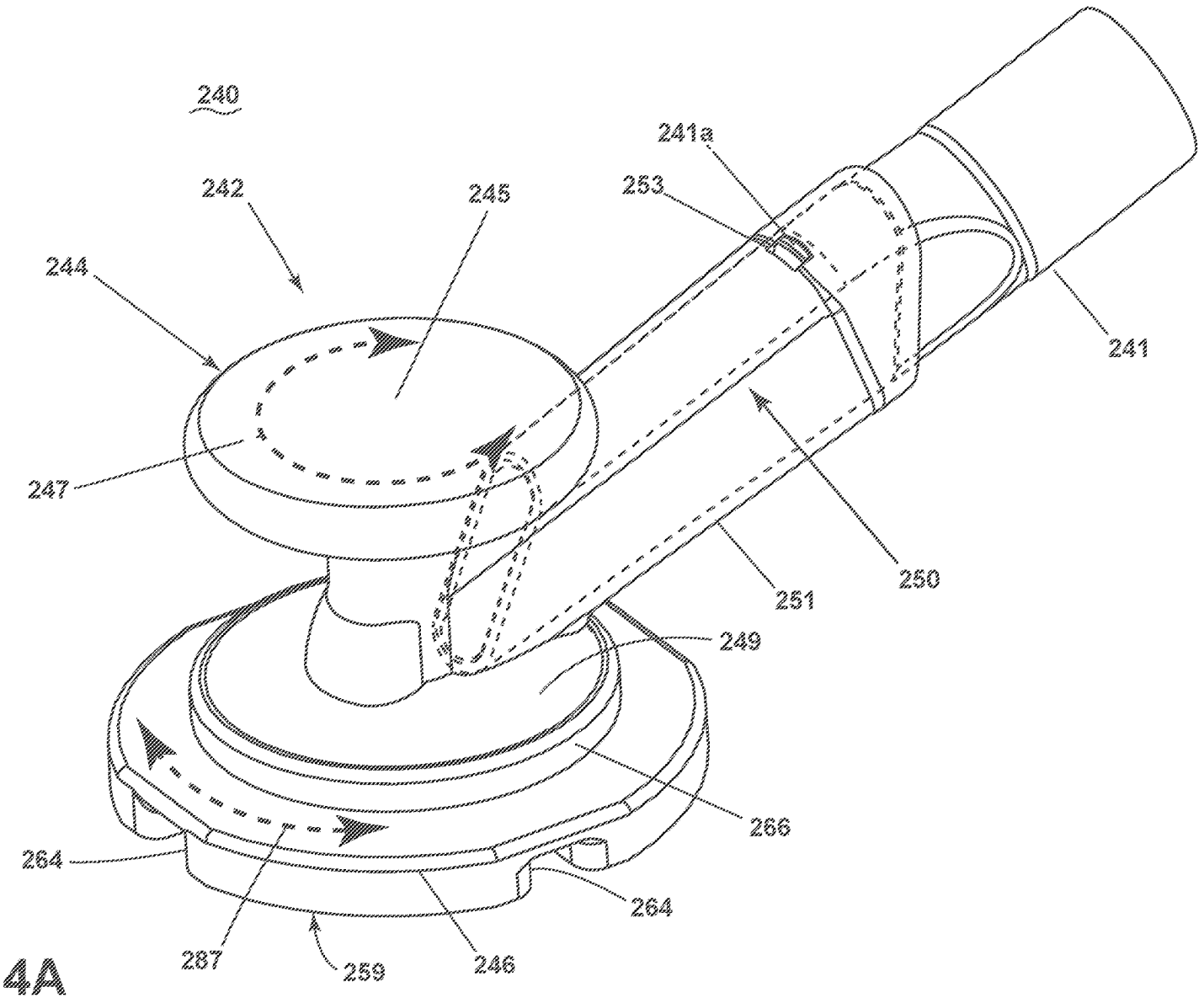
FIG. 4A is a perspective view of a vacuum cleaner accessory tool that can be utilized with the vacuum cleaner of FIG. 1 according to various aspects described herein.
Figure 4B:
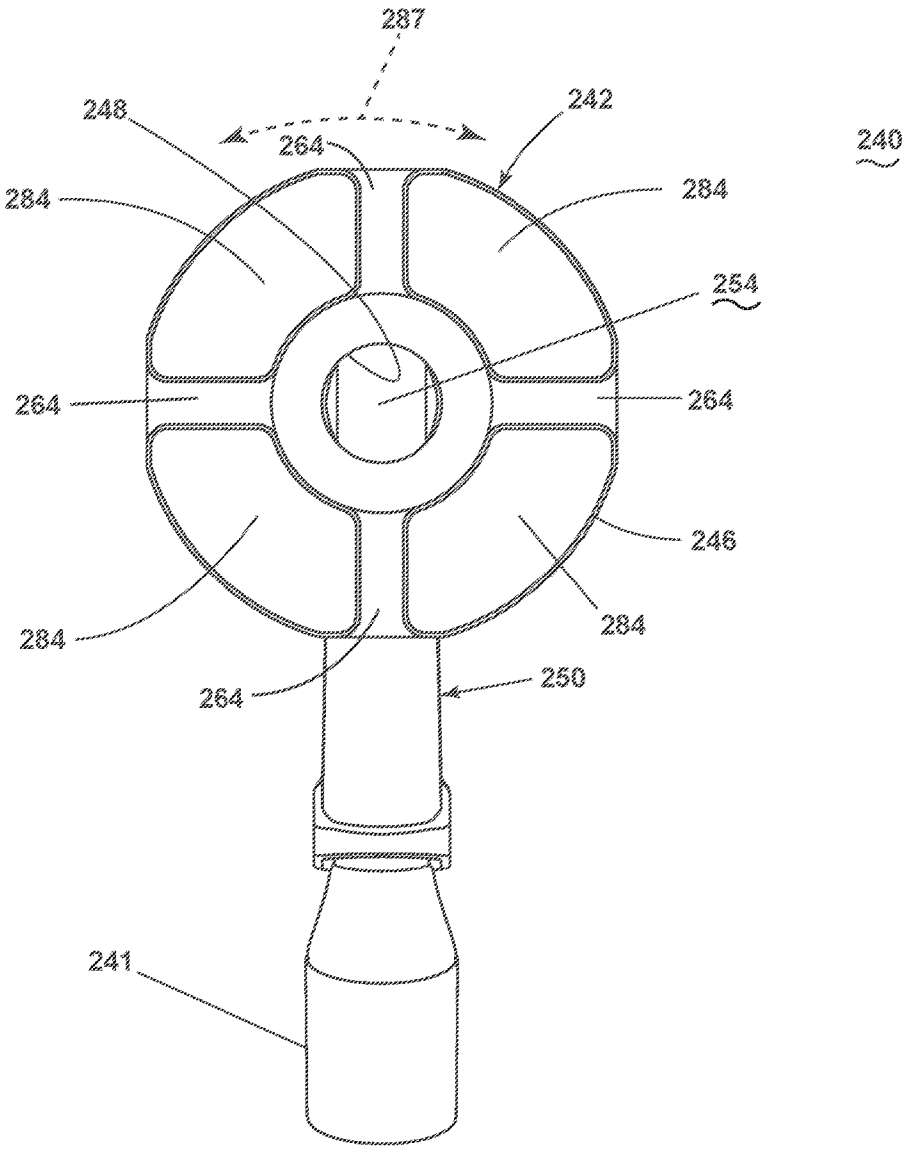
FIG. 4B is a bottom view of the vacuum cleaner accessory tool of FIG. 4A.

FIGS. 4A-4B illustrate another accessory tool 240 that can be utilized with the vacuum cleaner of FIG. 1 according to another aspect of the present disclosure, and includes similar components as described for the accessory tool 40 and the accessory tool 140. Therefore, like parts will be identified with like numerals in the 200 series with it being understood that the description of the like parts applies to the accessory tool 240, unless otherwise noted.

Like the accessory tool 140, the accessory tool 240 includes an underside 259 that is generally flat instead of domed. The underside 259 includes the profile changes for the suction nozzle inlet 254 at its center and the set of channels 264 but is otherwise generally flat.

One difference is that a grip 245 is formed at an upper portion of the main housing assembly 242 and can rotate freely with respect to a remainder of the main housing assembly, which can improve feel and usability. Rotational movement is shown schematically via arrow 247.

Another difference is that the upper housing 244 includes a lower portion 249 about which the lower housing 246 rotates. More specifically, by way of non-limiting example, a rotatable bearing 266 can be formed by a portion of the lower housing 246. The rotatable bearing 266 can be mounted on the lower portion 249 such that the lower housing 246 is freely rotatable with respect to the upper housing 244 as illustrated by arrow 287.

Yet another difference is that vacuum hose end 34*a* (FIG. 1) can be operably coupled with a wand or crevice tool 241. The crevice tool 241 is adapted to be slidably received within the conduit 251, which forms a crevice tool mount for holding the crevice tool 241 and can also act as a handle. A latch 241*a* is adapted to releasably secure the crevice tool 241 within the conduit 251 via a catch 253.

As best seen in FIG. 4B, like the accessory tool 40 it can be seen that the accessory tool 240 is illustrated as including four first hair collecting elements 284 including unidirectional oriented fibers (not shown). The accessory tool 240 operates in the same manner as described above for the accessory tools 40 and 140 including having a rotational lower housing, as schematically illustrated by arrow 287, adapted to create a twisting and balling or accumulation of the removed hair such that the aggregated hair is moved towards the suction nozzle inlet 254 and removed during use. The accessory tool 240 removes pet hair with a side-to-side motion, front-to-back or top-to-bottom motion, as well as with a circular or semi-circular motion.

Figure 5A:
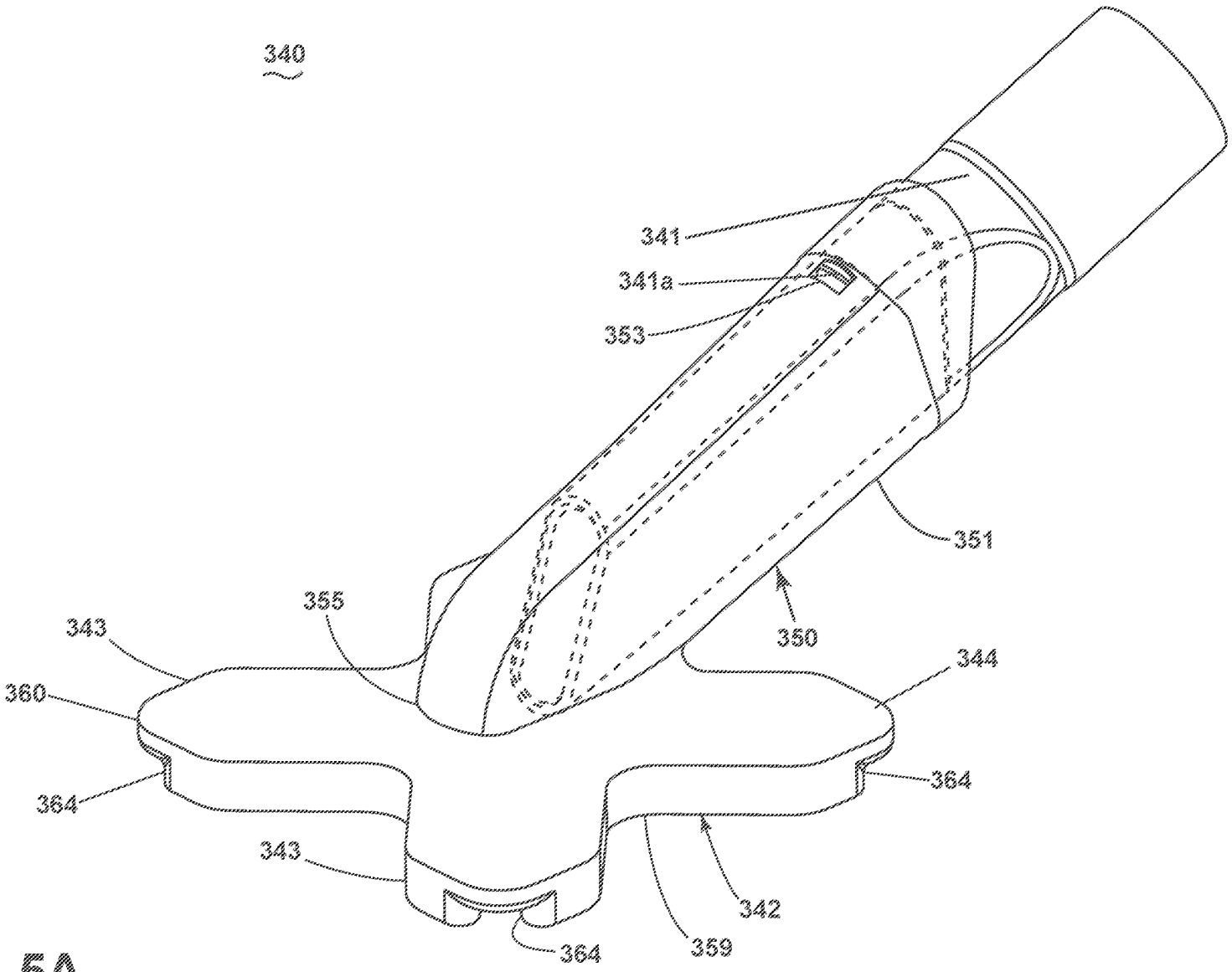
FIG. 5A is a perspective view of a vacuum cleaner accessory tool that can be utilized with the vacuum cleaner of FIG. 1 according to various aspects described herein.

FIG. 5A is a perspective view of a vacuum cleaner accessory tool 340 that includes similar components as described for the accessory tool 240; therefore, like parts will be identified with like numerals increased by 100 with it being understood that the description of the like parts applies to the accessory tool 340, unless otherwise noted. Like the accessory tool 240, the accessory tool 340 can also receive a crevice tool 341 or wand.

One difference is that the main housing assembly 342 is a single or unitary piece that is not rotatable. Instead the main housing assembly includes multiple prongs or fingers 343 forming the lower portion 344 of the main housing assembly 342. It will be understood that any number of fingers can be includes in the main housing assembly 342 and that such fingers can be oriented in any suitable manner. In the illustrated example, by way of non-limiting example the fingers are oriented in an X-shape with a central hub 355 from which the hose attachment 350 defined by the conduit 351 extends.

Figure 5B:
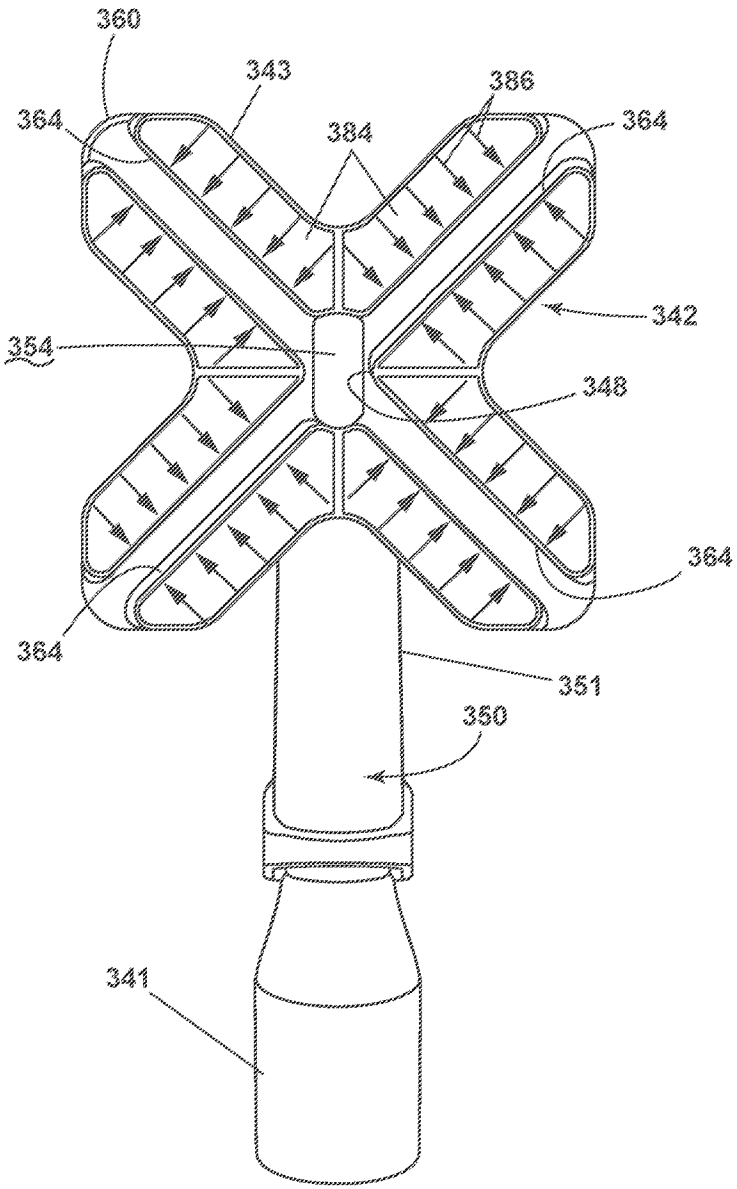
FIG. 5B is a bottom view of the vacuum cleaner accessory tool of FIG. 5A.

As with previous examples a set of channels 364 are formed in the underside 359, which is illustrated as being a relatively flat underside 359. Each of the set of channels 364 extends from a distal most end 360 of the finger 343 to a suction nozzle inlet 354 as illustrated in FIG. 5B. The suction nozzle 348 defines an elongated suction nozzle inlet 354, which is centrally located. It will be understood that this need not be the case and that the suction nozzle inlet can be shaped in any suitable manner and located in any suitable location. Further still a multiple number of suction nozzle inlets can be located therein.

Still referring to FIG. 5B, it can be seen that multiple first hair collecting elements 384 are located on the underside of the main housing assembly 342. More specifically, first hair collecting elements 384 are included on each finger 343 with one first hair collecting element 384 on each side of the channel 364. As illustrated, each of the first hair collecting elements 384 is an elongated piece with the unidirectional oriented fibers 386 oriented generally towards each of set of channels 364, respectively.

While the accessory tool 340 does not have a portion that freely rotates, the accessory tool 340 otherwise operates in the same manner as described above including that the accessory tool 340 is adapted to create a twisting and balling or accumulation of the removed hair such that the aggregated hair is moved towards the channels 364 and the suction nozzle inlet 354 and removed during use via suction from suction nozzle 248. The accessory tool 340 removes pet hair with a side-to-side motion, front-to-back or top-to-bottom motion, as well as with a circular or semi-circular motion.

Figure 6A:
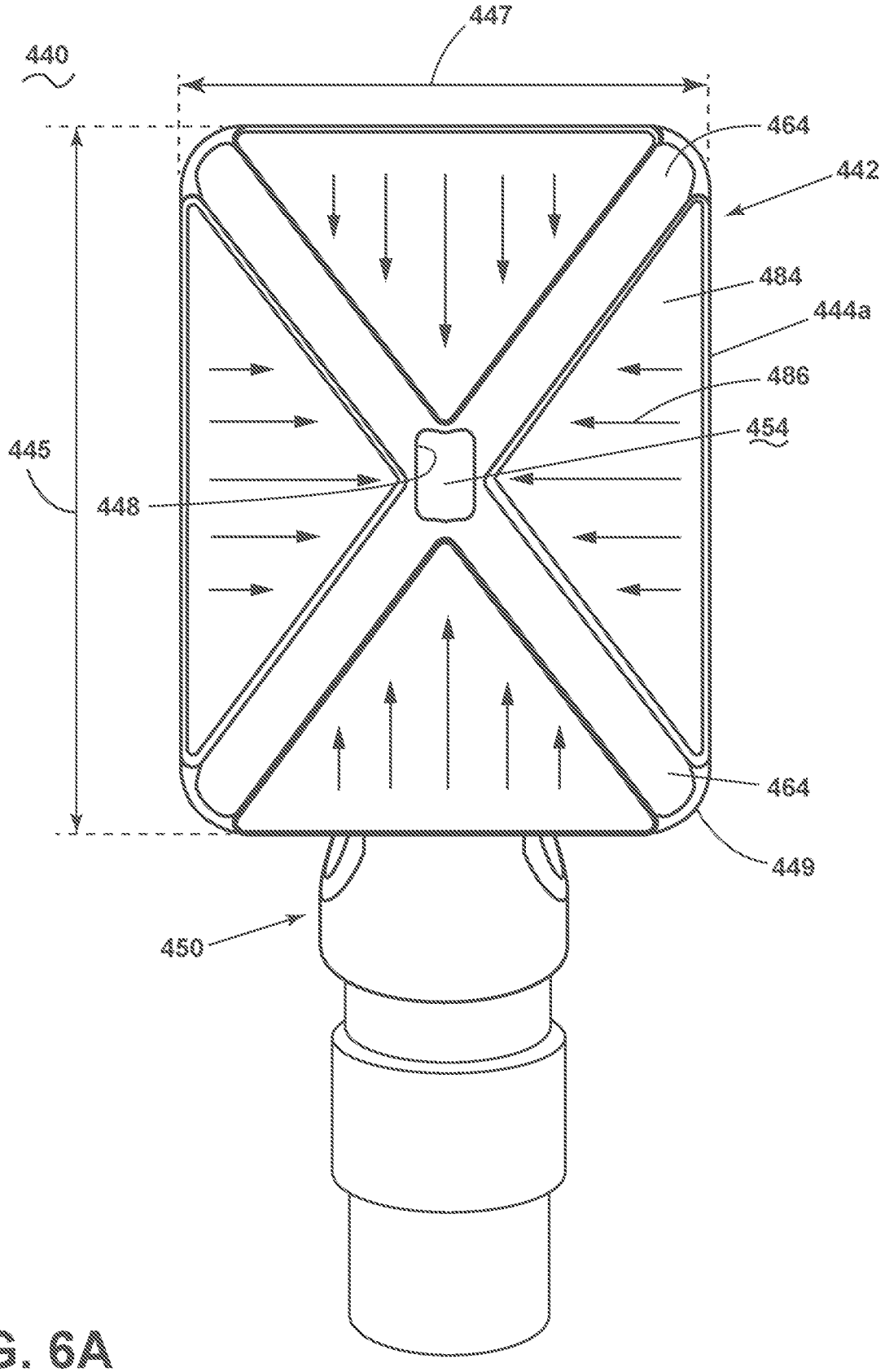
FIG. 6A is a bottom view of a vacuum cleaner accessory tool that can be utilized with the vacuum cleaner of FIG. 1 according to various aspects described herein.
Figure 6B:
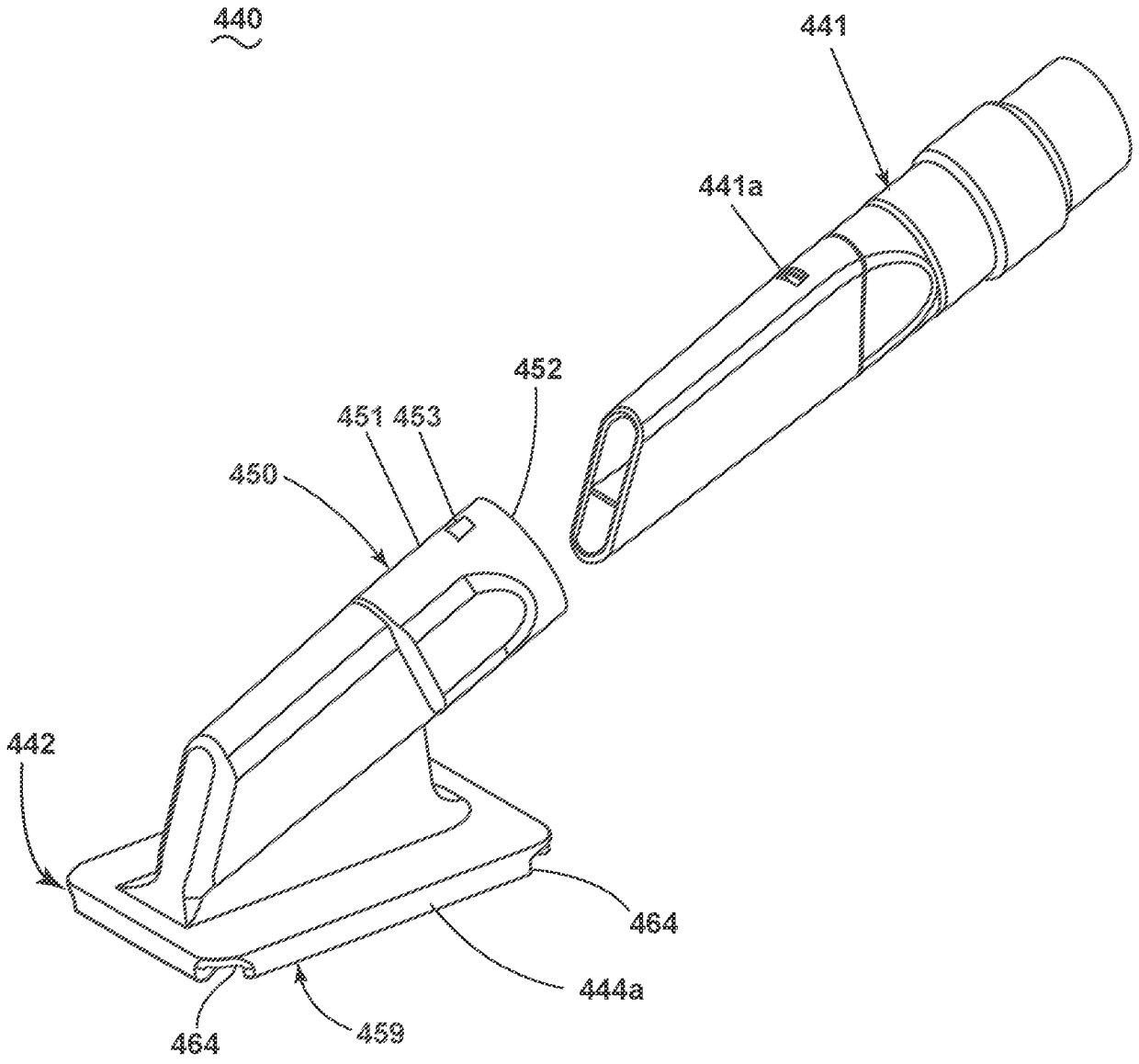
FIG. 6B is a partially exploded perspective view of the vacuum cleaner accessory tool of FIG. 6A.

FIGS. 6A-6B illustrate a vacuum cleaner accessory tool 440 that includes similar components as described for the accessory tool 340; therefore, like parts will be identified with like numerals increased by 100 with it being understood that the description of the like parts applies to the accessory tool 440, unless otherwise noted.

As with the accessory tool 340, the accessory tool 440 does not have a rotating portion of the main housing assembly 442. Instead an outer periphery 444*a* of the main housing assembly 442 forms a paddle. In the illustrated example, the outer periphery 444*a* is generally rectilinear including a length 445 and width 447 that is less than the length 445. The outer periphery 444*a* includes rounded corners 449.

The set of channels 464 form an X-shape and extend from each of the rounded corners 449 to a central suction nozzle inlet 454. While the suction nozzle inlet 454 is an elongated inlet that is centrally located and extends along a portion of the length of the outer periphery 444*a* this need not be the case.

In FIG. 6A, it can be seen that multiple first hair collecting elements 484 are located on the underside of the main housing assembly 442. The set of channels 464 divides the underside of the main housing assembly 442 and each of the first hair collecting elements 484 are sized accordingly to fit between the respective of the set of channels 464. As illustrated, the unidirectional oriented fibers 486 are oriented generally towards the suction nozzle inlet 454.

Referring to FIG. 6B, it can be seen that like the accessory tool 340, the accessory tool 440 can also receive a crevice tool 441 or wand. The crevice tool 441 can include a rotatable diverter that allows for suction airflow to be directed to the crevice tool 441 when rotated. The crevice tool 441 can include also include an indicator such as a light, which can be illuminated when suction is provided or when the accessory tool 440 is operably coupled and the latch 441*a* is depressed.

The accessory tool 440 operates in the same manner as described above for the accessory tool 340 including that the accessory tool 440 is adapted to release hair from a surface to be cleaned, accumulate the removed hair and suction of the aggregated hair via the channels 364 and inlet 354. In this manner the accessory tool 440 removes pet hair with a side-to-side motion, front-to-back or top-to-bottom motion, as well as with a circular or semi-circular motion and self-cleans.

Figure 7A:
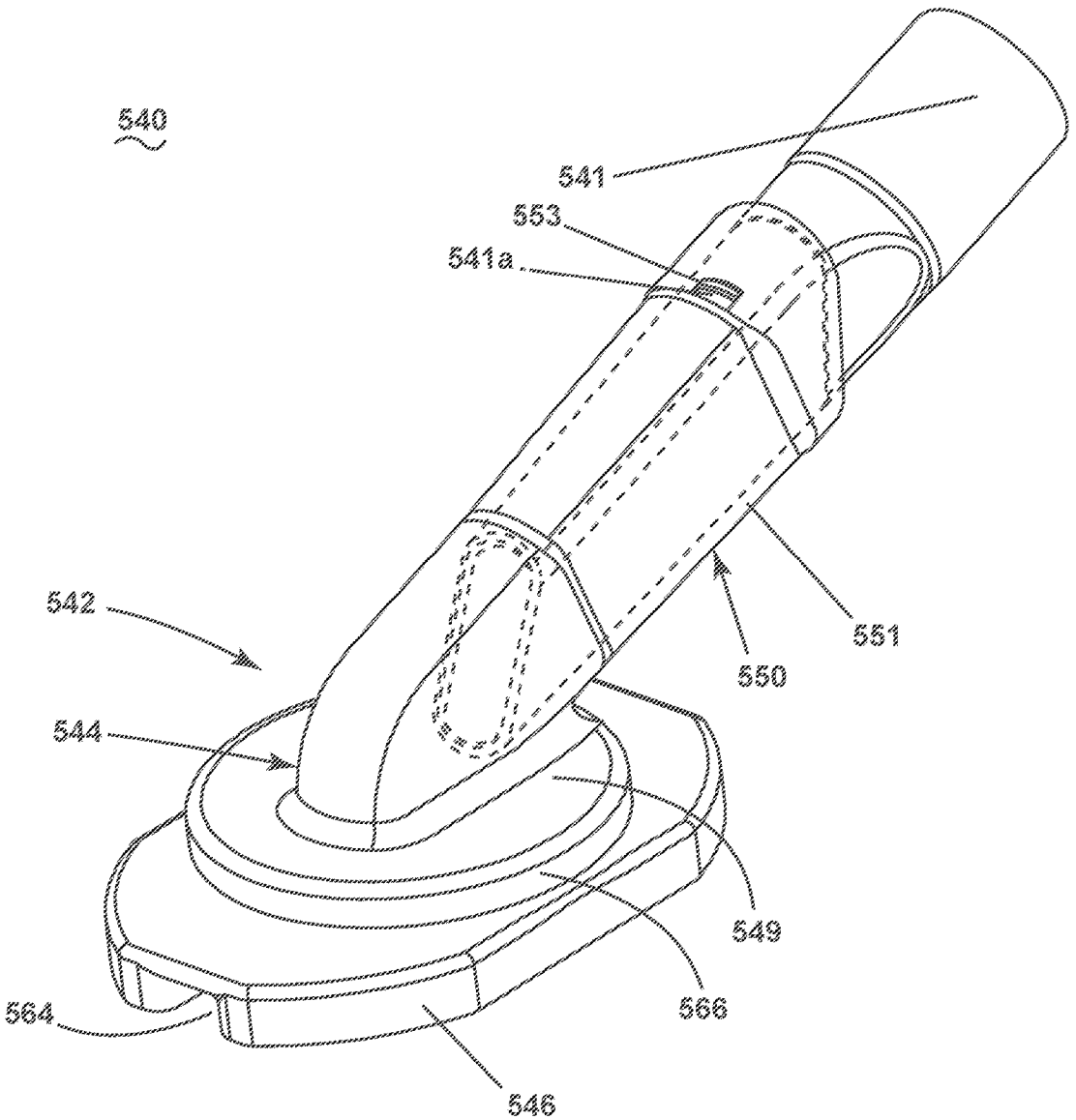
FIG. 7A is a perspective view of a vacuum cleaner accessory tool that can be utilized with the vacuum cleaner of FIG. 1 according to various aspects described herein.

FIG. 7A illustrates a vacuum cleaner accessory tool 540 that includes similar components as described for the accessory tool 240; therefore, like parts will be identified with like numerals increased by 300 with it being understood that the description of the like parts applies to the accessory tool 540, unless otherwise noted.

One similarity is that the upper housing 544 includes a lower portion 549 about which the lower housing 546 rotates. More specifically, by way of non-limiting example, a rotatable bearing 566 can be formed by a portion of the lower housing 546. The rotatable bearing 566 can be mounted on the lower portion 549 such that the lower housing 546 is rotatable.

While the accessory tool 540 includes a rotatable lower housing 546. One difference is that the rotatable lower housing 546 is not freely rotatable; instead, the rotatable lower housing 546 is indexable between two positions, a first position is shown in FIG. 7B and a second position is shown in FIG. 7C.

Figure 7B:
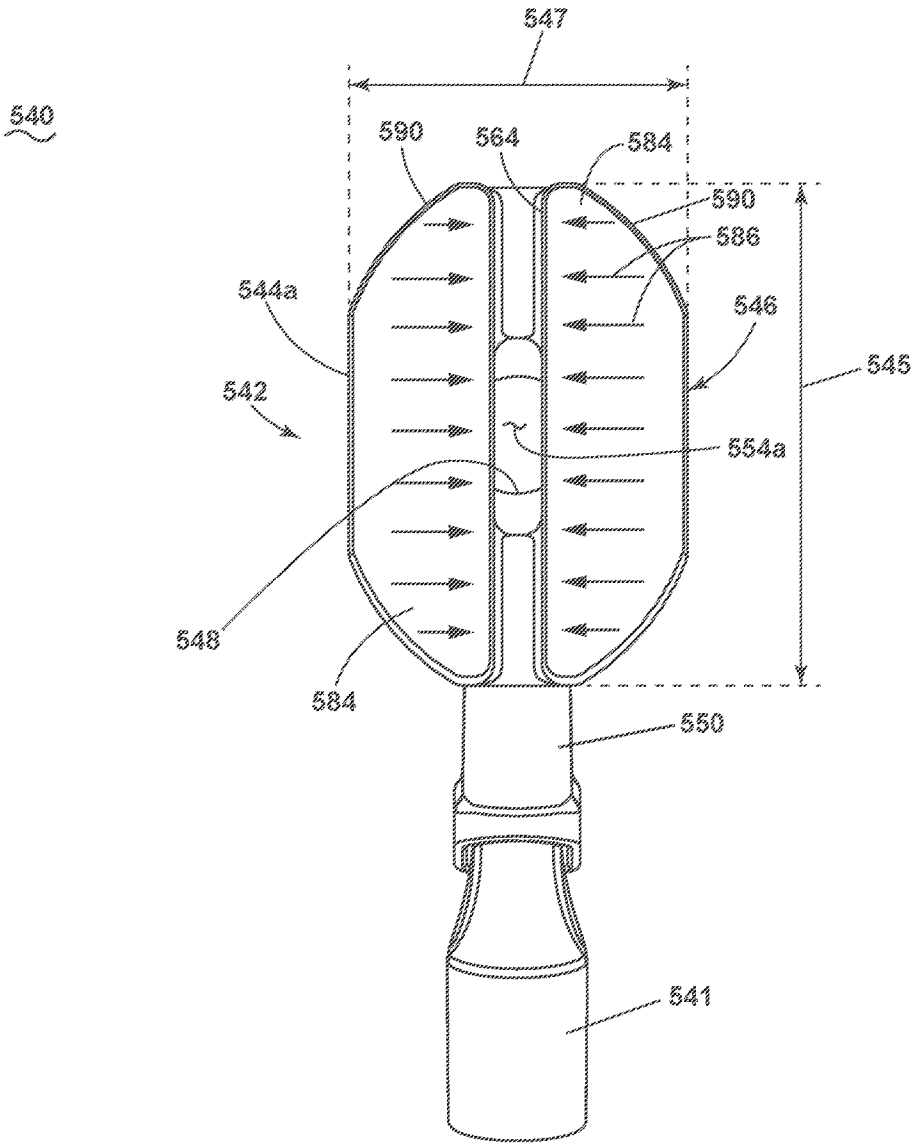
FIG. 7B is a bottom view with a head of the vacuum cleaner accessory tool of FIG. 5A in a first position.
Figure 7C:
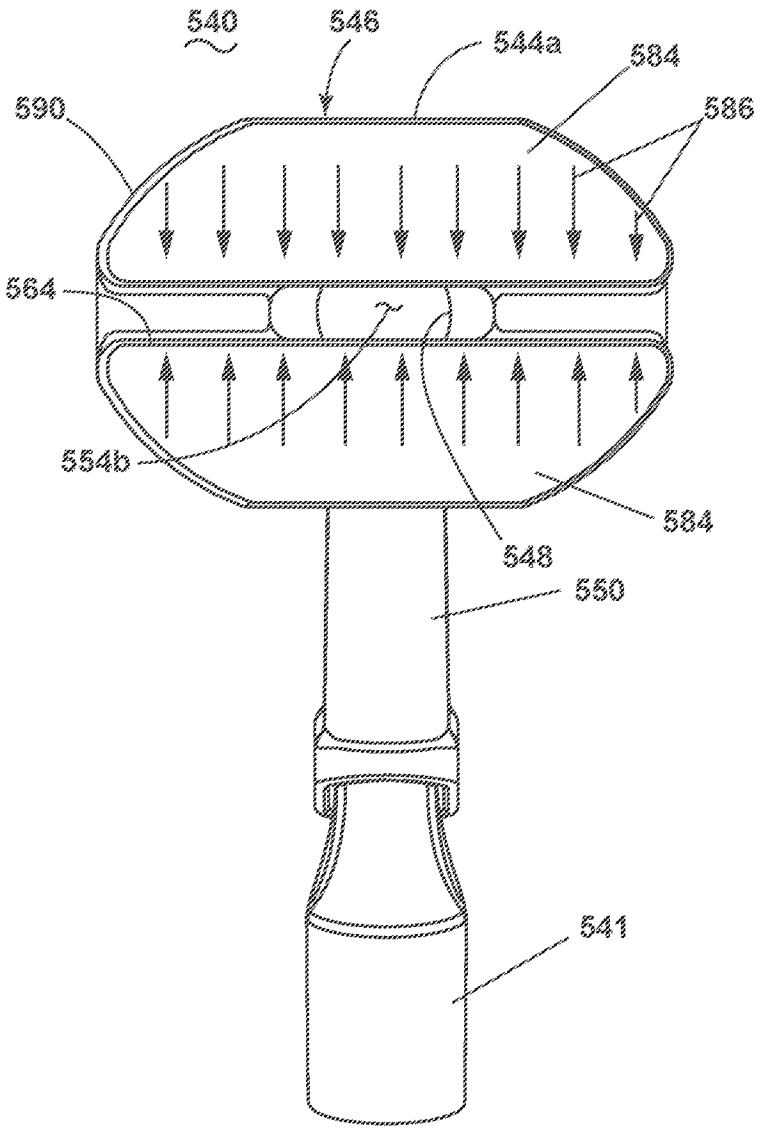
FIG. 7C is a bottom view with the head of the vacuum cleaner accessory tool of FIG. 5A in a second position.

As better shown in the bottom views of FIGS. 7B and 7C, the outer periphery 544*a* of the main housing assembly 542 forms a paddle. In the illustrated example, the outer periphery 544*a* includes a length 545 that is larger than the width 547 and includes elongated corners 590. It will be understood that the outer periphery 544*a* can include any suitable shape, profile, or contour.

Only a singular channel 564 is included and runs down a center length of the underside of the lower housing 546. A suction nozzle 548 is located centrally on an underside of the main housing assembly 542. In the illustrated example, as the lower housing 546 rotates between the two indexable positions (illustrated in FIGS. 7B and 7C) the shape, orientation, or opening of the suction nozzle inlet changes as a portion of the lower housing 546 overlies different portions of the suction nozzle 548. The suction nozzle inlet is shown in FIG. 7B as suction nozzle inlet 554*a* and suction nozzle inlet 554*b* in FIG. 7C. It will be understood that the elongated shape of the nozzle in either position generally aligns with the channel 564 in the respective position. It will be understood that the indexed positions shown in FIGS. 7B and 7C are generally perpendicular to each other allowing a user to change the orientation of the lower housing 546 with respect to the wand 541. It will further be understood that additional indexable positions can be included either intermediate to the two illustrated positions or beyond the two illustrated positions.

FIG. 7B also illustrates that first hair collecting elements 584 are located on the underside of the main housing assembly 542 at either side of the single channel 564. As illustrated, the unidirectional oriented fibers 586 are oriented towards the single channel 564 and the other of the first hair collecting elements 584.

The accessory tool 540 operates in the same manner as described above for the accessory tool 240 including that the accessory tool 540 is adapted to release hair from a surface to be cleaned, accumulate the removed hair and suction of the aggregated hair via the channel 564, and suction nozzle inlet 554. However, the accessory tool 540 removes pet hair with a side-to-side motion or front-to-back or top-to-bottom motion based on the orientation or indexed position of the lower housing 546.

Figure 8A:
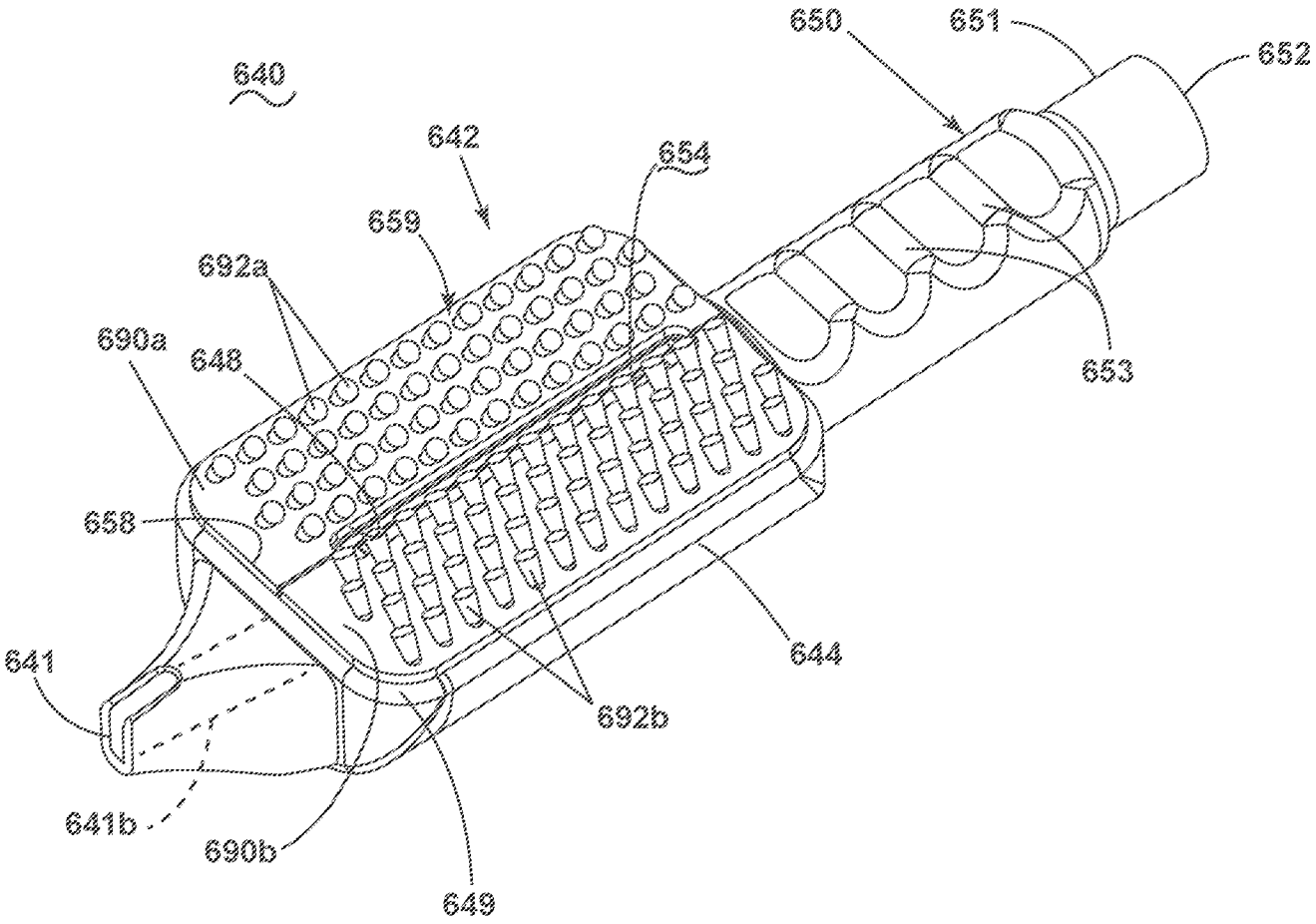
FIG. 8A is top perspective view of a vacuum cleaner accessory tool that can be utilized with the vacuum cleaner of FIG. 1 according to various aspects described herein.
Figure 8B:
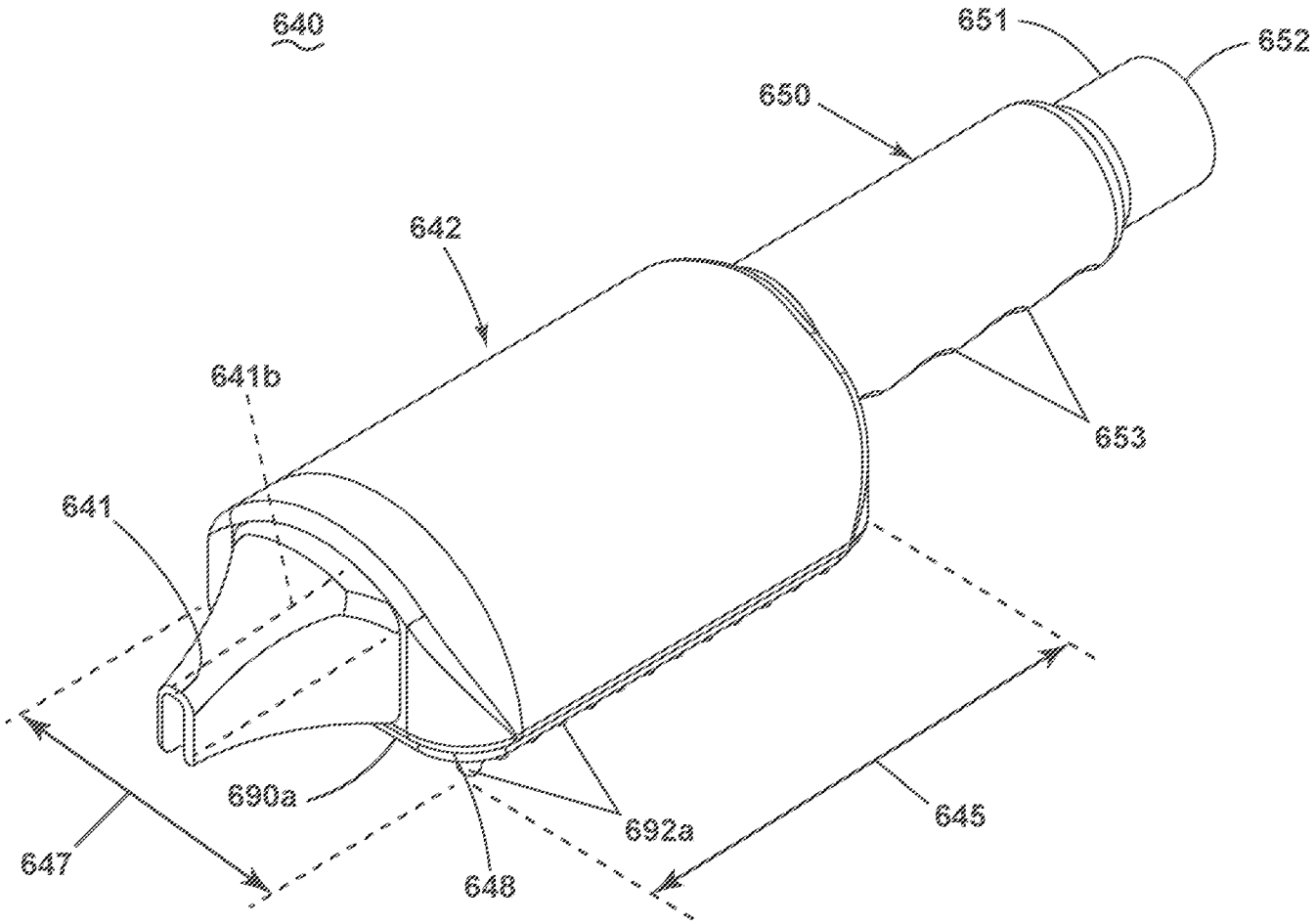
FIG. 8B is a bottom perspective view of the vacuum cleaner accessory tool of FIG. 8A.

FIGS. 8A and 8B illustrate another vacuum cleaner accessory tool 640 that can be utilized with the vacuum cleaner of FIG. 1 to remove pet hair from a surface to be cleaned. The accessory tool 640 includes similar components as described for the accessory tool 340; therefore, like parts will be identified with like numerals increased by 300 with it being understood that the description of the like parts applies to the accessory tool 640, unless otherwise noted.

One difference is that instead of having a receiver for a crevice tool or wand, a distal most portion of the accessory tool 640, opposite the hose attachment 650, forms a crevice tool portion 641. The crevice tool portion 641 at the end of the accessory tool 640 is fluidly coupled to the conduit 651 via a fluid passageway 641*b*, which in turn forms a portion of the working airflow to the vacuum cleaner of FIG. 1.

The underside of the main housing assembly 642 also forms a hair remover paddle having first and second sides 690*a* and 690*b*. The first and second sides 690*a* and 690*b* forming the underside 659 are oriented in an inclined fashion towards the outside width of the main housing assembly 642. In the illustrated example, the outer periphery 644*a* includes a length 645 that is larger than the width 647 and includes rounded corners 649. It will be understood that the outer periphery 644*a* can include any suitable shape, profile, or contour.

An elongated suction nozzle 648 at the juncture of the first and second sides 690*a* and 690*b* forms a suction nozzle inlet 654, which runs down a center length of the underside 659 of the main housing assembly 642. The inclined first and second sides 690*a* and 690*b* form a V-shape towards the suction nozzle inlet 654.

Each of the first and second sides 690*a* and 690*b* also has hair collecting elements 692*a* and 692*b*, respectively. The hair collecting elements 692*a* and 692*b* can include, by way of non-limiting example, alternative hair collecting material such as elastomeric nubs for removing hair from the surface to be cleaned. The hair collecting elements 692*a* and 692*b* can also be oriented or angled in a manner that improves the release of hair from the surface to be cleaned.

Yet another difference is that the conduit 651 has ridges 653 that are adapted to form a built-in grip to aid a user in grasping the accessory tool 640. The accessory tool 640 operates in the same manner as described above for the accessory tool 340 including that the accessory tool 640 is adapted to release hair from a surface to be cleaned, accumulate the removed hair and suction of the aggregated hair via the suction nozzle inlet 654. However, the accessory tool 640 removes pet hair with a side-to-side motion and includes the functionality of a crevice tool portion 641 at its distal most end.

Figure 9A:
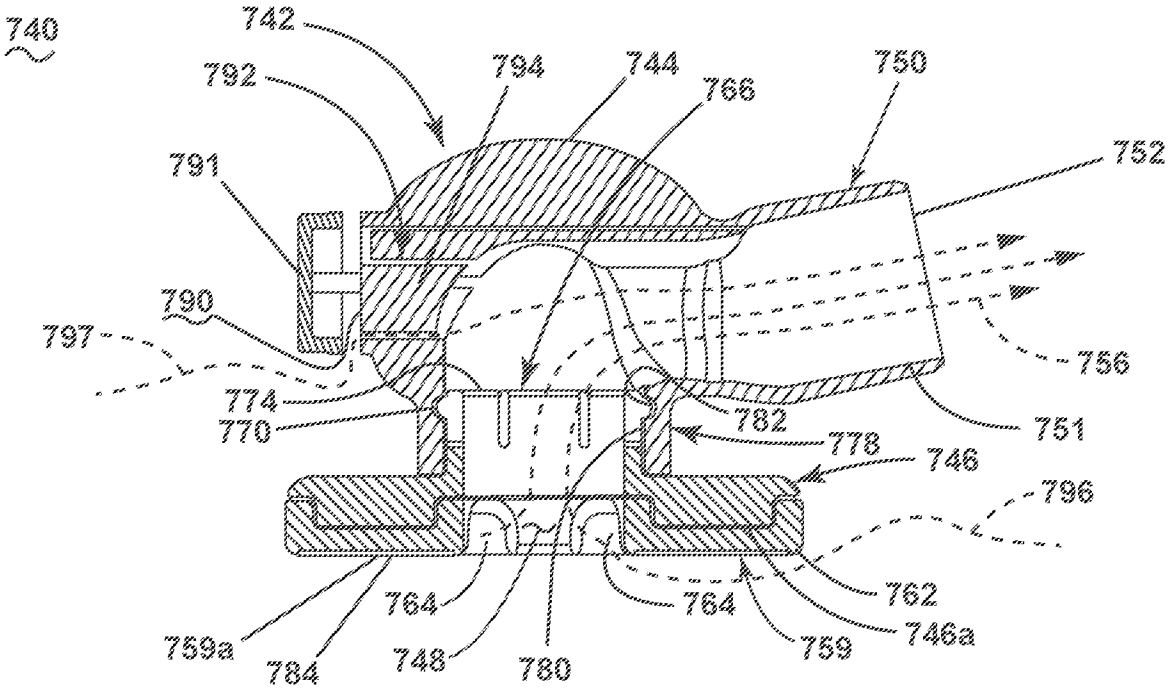
FIG. 9A is a cross-sectional view of a vacuum cleaner accessory tool that can be utilized with the vacuum cleaner of FIG. 1 according to various aspects described herein.
Figure 9B:
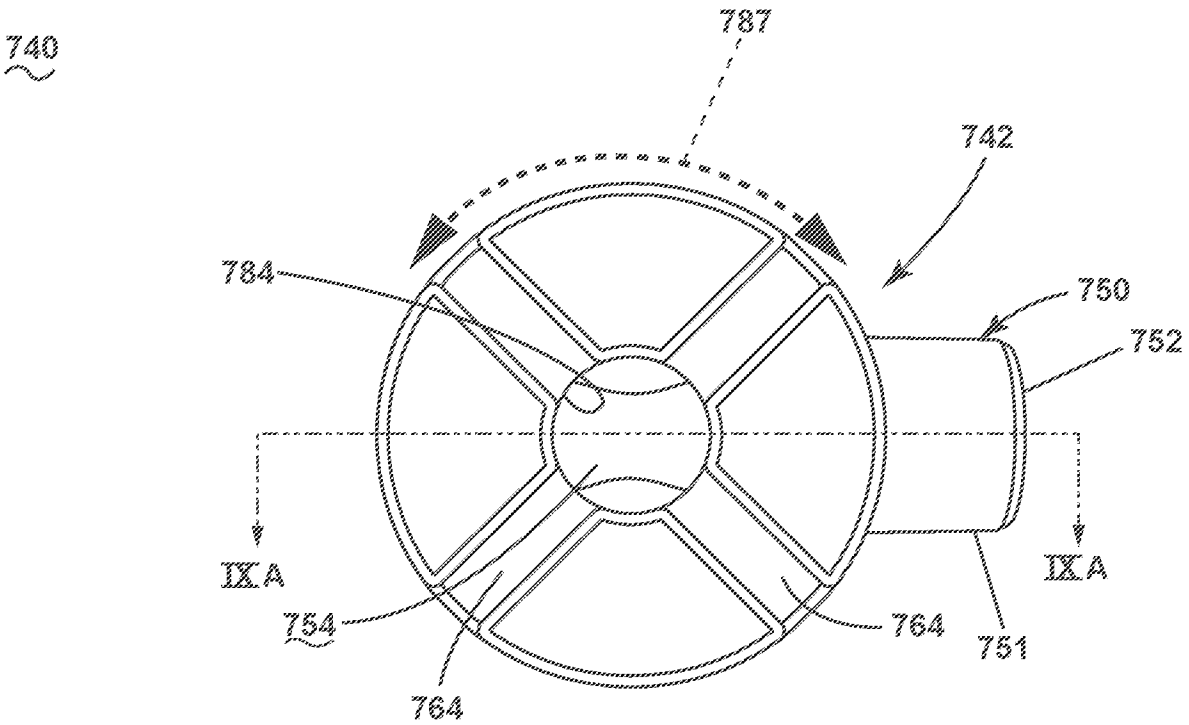
FIG. 9B is a bottom view of the vacuum cleaner accessory tool of FIG. 9A.

FIGS. 9A-9B illustrate another accessory tool 740 that can be utilized with the vacuum cleaner of FIG. 1 according to another aspect of the present disclosure, and includes similar components as described for the accessory tool 40 and the accessory tool 140. Therefore, like parts will be identified with like numerals in the 700 series with it being understood that the description of the like parts applies to the accessory tool 740, unless otherwise noted.

Like the accessory tool 140, the accessory tool 740 includes a main housing assembly 742 with both an upper housing 744 and a lower housing 746 with an underside 759 that is generally flat instead of domed. The underside 759 includes the profile changes for the suction nozzle inlet 754 at its center and the set of channels 764 but is otherwise generally flat. However, one difference is that a changeable bottom plate forms the underside 759 and can be removably mounted to a distal portion 746*a* of the lower housing 746. The changeable bottom plate is mounted to the distal portion 746*a* such that it is mounted to and rotates freely with the lower housing 746. The set of channels 764 and the hair removal material are located on the underside 759 formed by the changeable bottom plate.

Another difference is that the upper housing 744 includes an air leakage feature 792 adapted to tune the suction force through the suction nozzle inlet 754. More specifically, an opening or port 790 has been included in the upper housing 744 along with an adjustable control knob 791. The adjustable control knob 791 is operably coupled to a moveable body 794 located within the port 790 that is selectively moveable to control the opening, closing, and size of the port 790 to control the suction force through the suction nozzle inlet 754. Twisting the knob 791 in a first direction enlarges the port 790, creating or increasing the air leak, illustrated schematically at 797, and lowering the suction power through the suction nozzle inlet 754. Conversely twisting the knob 791 in a second direction, opposite the first, decreases the size of the port 790 or closes it entirely and increases the suction force at the suction nozzle inlet 754. Adjusting the amount of air leakage changes the suction pressure at the bottom surface or underside 759 of the tool, which in turn changes the push/pull force felt by a user as well as the amount of air flow pulling pet hair free from the upholstery. Tighter upholstery materials allow for higher suction pressure before push/pull forces become uncomfortable. It will be understood that a cleaning airflow 796 still travels through the airflow path 756 via optionally the channels 764, the suction nozzle inlet 754, and interior portions of the main housing assembly 742.

Figure 10:
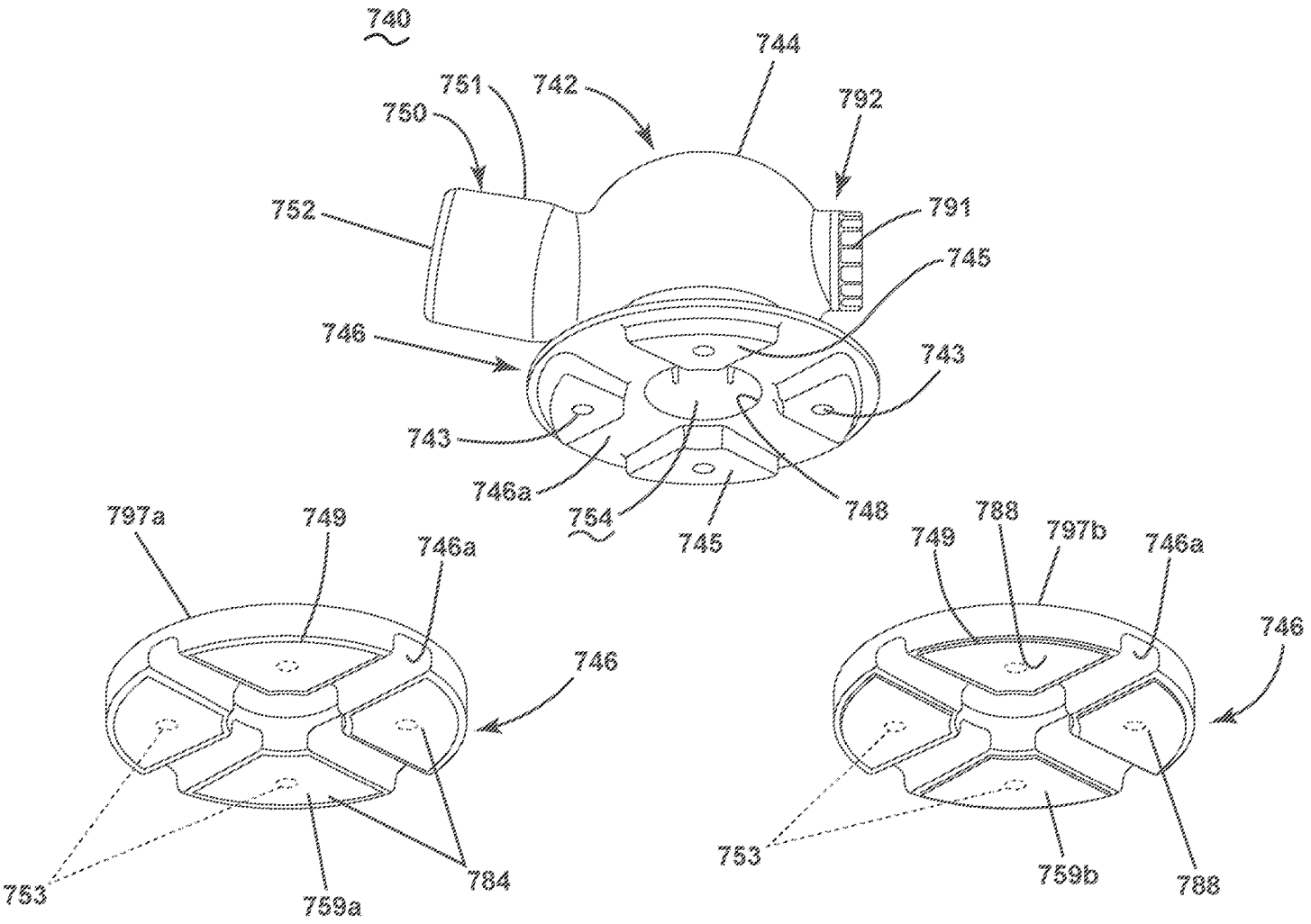
FIG. 10 is partially exploded view of the vacuum cleaner accessory tool of FIG. 9A illustrating interchangeable hair collection plates.

FIG. 10 illustrates that a first changeable plate 797*a* having only first hair collecting elements 784 including unidirectional oriented fibers (not shown) and a second changeable plate 797*b* having only second hair collecting elements 788 can be selectively mounted to the lower housing 746 of the accessory tool 740. It will be understood that alternative changeable plates having both first and second hair collecting elements or alternative hair collecting elements are contemplated.

One exemplary method of selectively coupling the first changeable plate 797*a* and the second changeable plate 797*b* to the distal end 746*a* of the lower housing 746 is also illustrated. More specifically, magnets 743 having a first polarity are illustrated as being included on the distal end 746*a* of the lower housing 746. Magnets 753 of a second polarity, opposite that of the first polarity are illustrated as being located on the interior surface of the first changeable plate 797*a* and the second changeable plate 797*b*. Having changeable bottom plates and thus allowing for changes in hair collecting elements allows for higher and lower friction properties, which also balances hair removal performance with push/pull force comfort and self-cleaning ability.

Further still, the distal end 746*a* of the lower housing 746 and the interior surface of the first changeable plate 797*a* and the second changeable plate 797*b* will be understood to have complementary geometries. By way of non-limiting example, the distal end 746*a* of the lower housing 746 includes projections 745 that nest within recesses or pockets 749 of the first changeable plate 797*a* and the second changeable plate 797*b*. While these have been illustrated as coinciding with the respective location of the hair removal collecting elements this need not be the case. Further still, while the magnets have been illustrated as being located at such nesting profile features the magnets may also be located at any suitable locations.

The accessory tool 740 operates in the same manner as described above for the accessory tools 40 and 140 including having a rotational lower housing 746 adapted to create a twisting and balling or accumulation of the removed hair such that the aggregated hair is moved towards the suction nozzle inlet 754 and removed during use. The accessory tool 740 removes pet hair with a side-to-side motion, front-to-back or top-to-bottom motion, as well as with a circular or semi-circular motion.

Figure 11A:
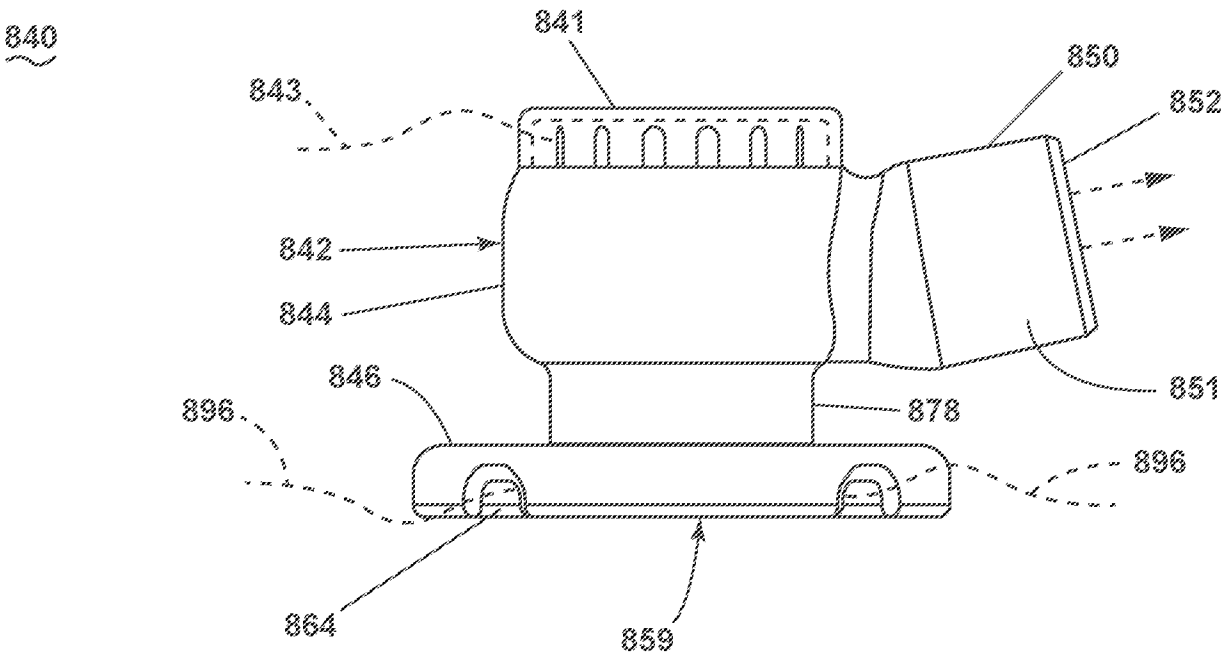
FIG. 11A is a side perspective view of a vacuum cleaner accessory tool that can be utilized with the vacuum cleaner of FIG. 1 according to various aspects described herein.

FIG. 11A illustrates another accessory tool 840 and includes similar components as described for the accessory tool 40 and the accessory tool 140. Therefore, like parts will be identified with like numerals in the 800 series with it being understood that the description of the like parts applies to the accessory tool 840, unless otherwise noted. Like the accessory tool 140, the accessory tool 840 includes a main housing assembly 842 with both an upper housing 844 and a lower housing 846 with an underside 859 that is generally flat other than the channels 864. One difference is that an air turbine assembly 841 is included in the accessory tool 840 and is operably coupled to rotationally drive the lower housing 846 instead of having the lower housing 846 freely rotatable.

Figure 11B:
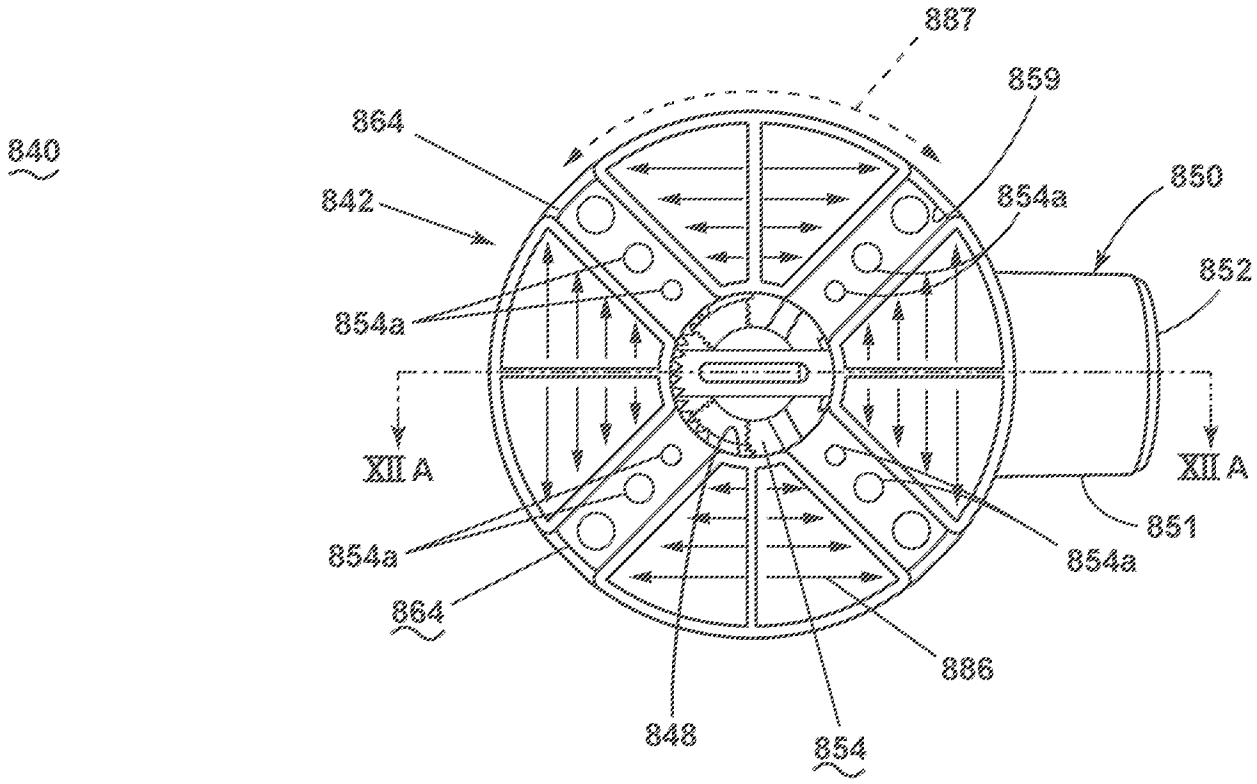
FIG. 11B is a bottom view of the vacuum cleaner accessory tool of FIG. 11A.

As better illustrates in FIG. 11B, another difference is that two first hair collecting elements are located between each set of channels 864. Each pair of first hair collecting elements 884 has alternative unidirectional oriented fibers 886 as illustrated by the arrows. Thus, instead of having a single piece of material between each set of channels 864 there are two pieces of material and each has unidirectional oriented fibers extending in opposite directions and generally directed towards the adjacent channel 864. Further still, suction relief holes 854*a* can be seen in an underside 859 of the lower housing 846 along the sets of channels 864.

Figure 12A:
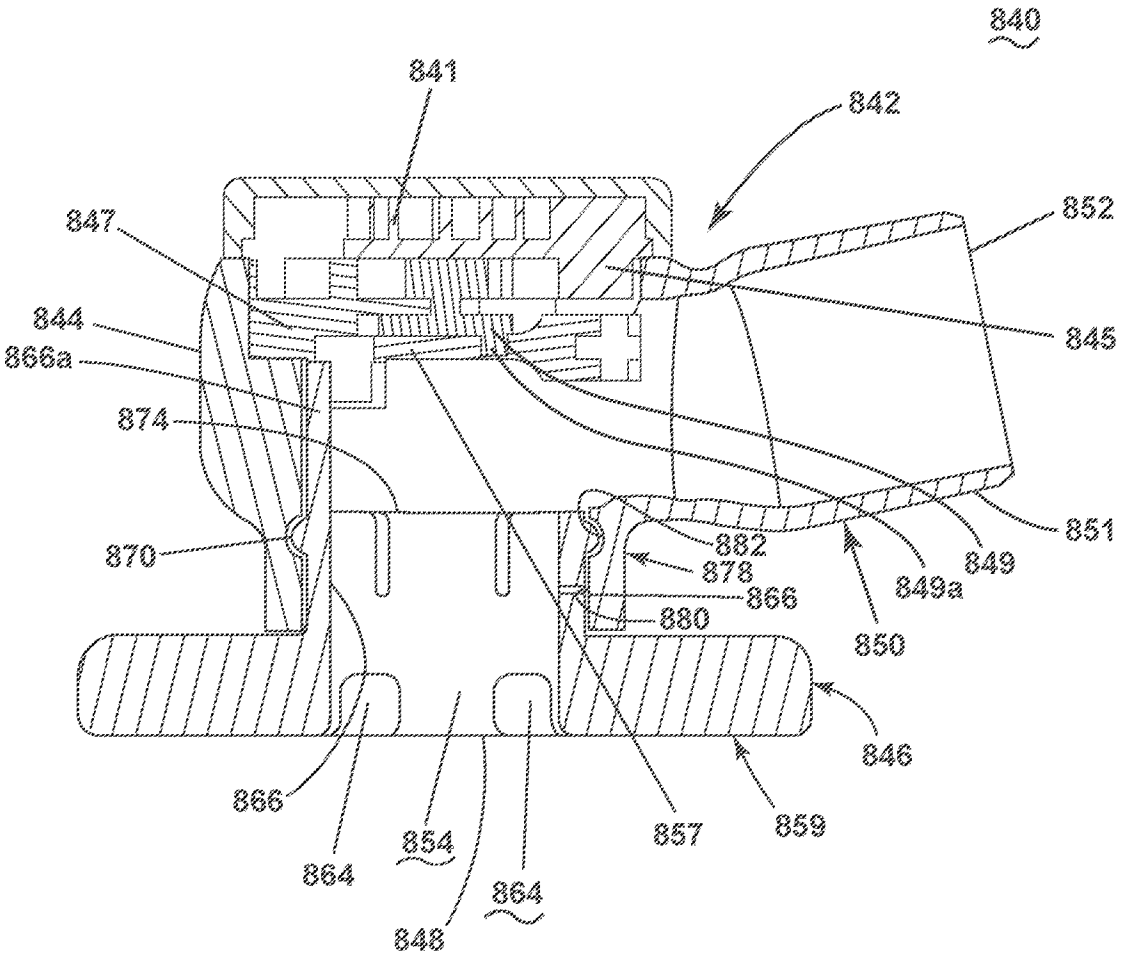
FIG. 12A is a cross-sectional view of the vacuum cleaner accessory tool of FIG. 11A.
Figure 12B:
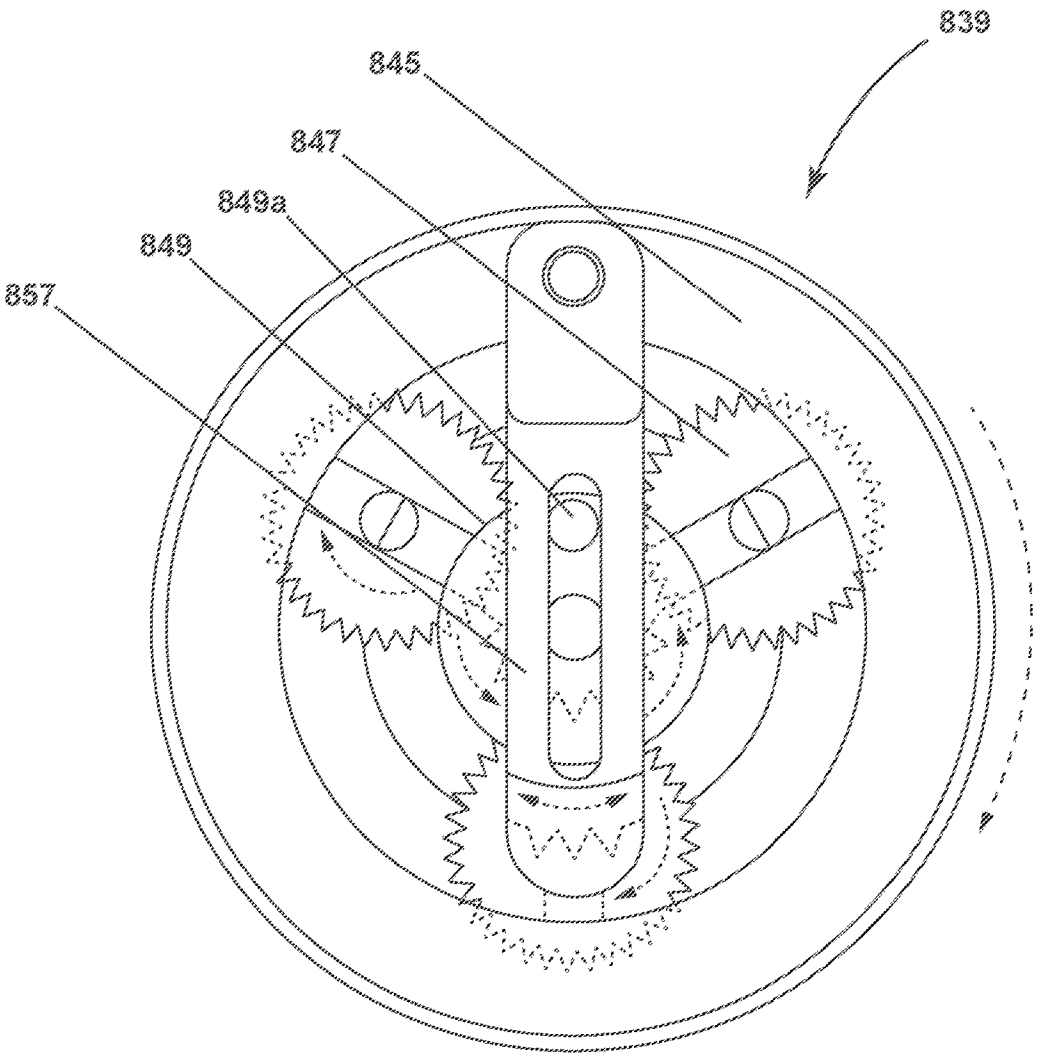
FIG. 12B is a top view of a gear assembly of the vacuum cleaner accessory tool of FIG. 11A.

FIG. 12A illustrates a cross-section of the accessory tool 840 and better illustrates that a gear train and link assembly 839 operably couples the air turbine 841 and the lower housing 846. More specifically, the air turbine 841 provides input to a turbine ring gear 845 of a planetary gear system including planet gears 847 and a sun gear 849. The sun gear 849, which provides an output for the gear train includes a pin 849*a* therein that is housed within a slot of a pivot link 857 that is operably coupled to the first conduit portion 866 of the lower housing 846. More specifically an extension 866*a* of the conduit can be operably coupled to the pivot link 857. The gear train and link assembly is shown in FIG. 12B with rotational arrows to illustrate the movement of the gears during operation.

The accessory tool 840 operates in the same manner as described above for the accessory tools 40 and 140 including having a lower housing adapted to remove or liberate hair from a surface, create an accumulation of the removed hair, and suction of the removed hair such that the accessory tool 840 is adapted to self-clean. More specifically, during operation the air turbine 841 generates rotational motion using a portion of the air flow 843 (FIG. 11A) drawn through the air turbine from the attached vacuum source (FIG. 1). The planetary gear train and link assembly 839 is used to reduce the speed and amplify the torque from the air turbine 841. The output of the planetary gear reduction is used to drive the pivot link 857 that in turn drives the lower housing 846 of the accessory tool 840. The lower housing 846 of the accessory tool 840 oscillates to remove embedded pet hair from upholstery in one direction and to release the liberated hair into the primary suction air flow path in the other direction. The lay direction of the hair removal material is oriented to facilitate hair removal and hair release as the direction of rotation reverses or oscillates. Slots or channels 864 in the lower housing 846 provide a path for suction air flow 896 and suction relief holes 854*a* are used to tune the suck-down force. The accessory tool 840 removes pet hair with a side-to-side motion, front-to-back or top-to-bottom motion, as well as with a circular or semi-circular motion by the user. It will be understood that regardless of the motion of the user that the air turbine 841 drives the lower housing 846 and the underside thereof to oscillate.

Figure 13:
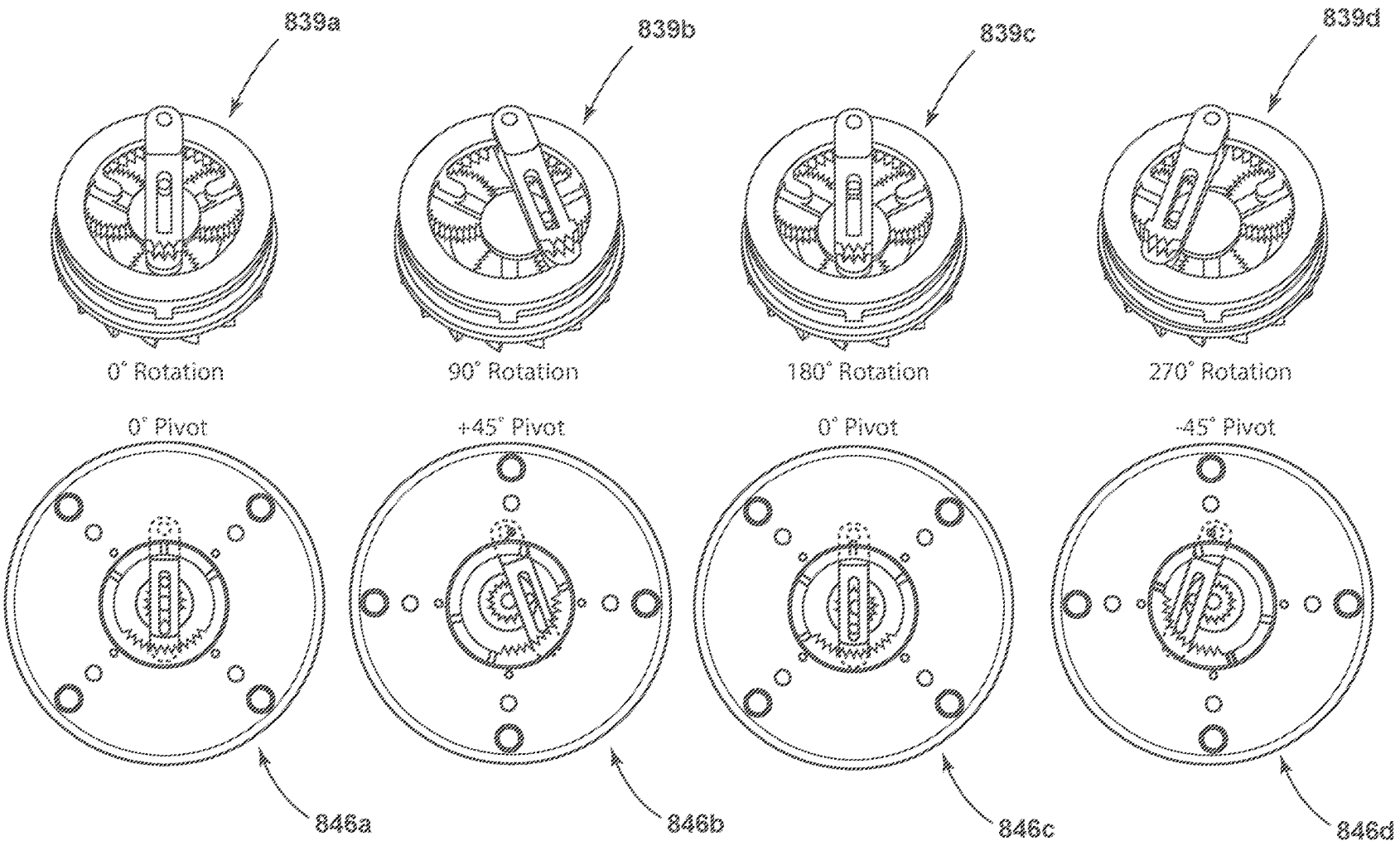
FIG. 13 are perspective views of portions of the vacuum cleaner accessory tool of FIG. 11A illustrating the gear assembly therein in separate rotational positions.

As can be seen in FIG. 13, a full rotation of the air turbine 841 and thus the ring gear 845 create an oscillating movement of the underside 859 of the lower housing 846. More specifically the oscillating movement is that of first a 45-degree counter-clockwise and then a 45-degree clockwise movement of the underside of the lower housing. FIG. 13 begins showing the gear train and link assembly 839*a* at a home position or with zero-degrees rotation and a corresponding zero-degree or home location of the lower housing 846*a*. When the gear train and link assembly 839 rotate 90 degrees as illustrated at 839*b* the lower housing moves to a positive 45-degree position as illustrated at 846*b*. When the gear train and link assembly 839 continues to rotate another 90 degrees and has thus rotated 180 degrees from the home position, as illustrated at 839*c*, the lower housing moves to the home or zero-degree position as illustrated at 846*c*. When the gear train and link assembly 839 continues to rotate another 90 degrees and has thus rotated 270 degrees from the home position, as illustrated at 839*d*, the lower housing moves to a negative 45-degree position as illustrated at 846*d*.

Figure 14A:
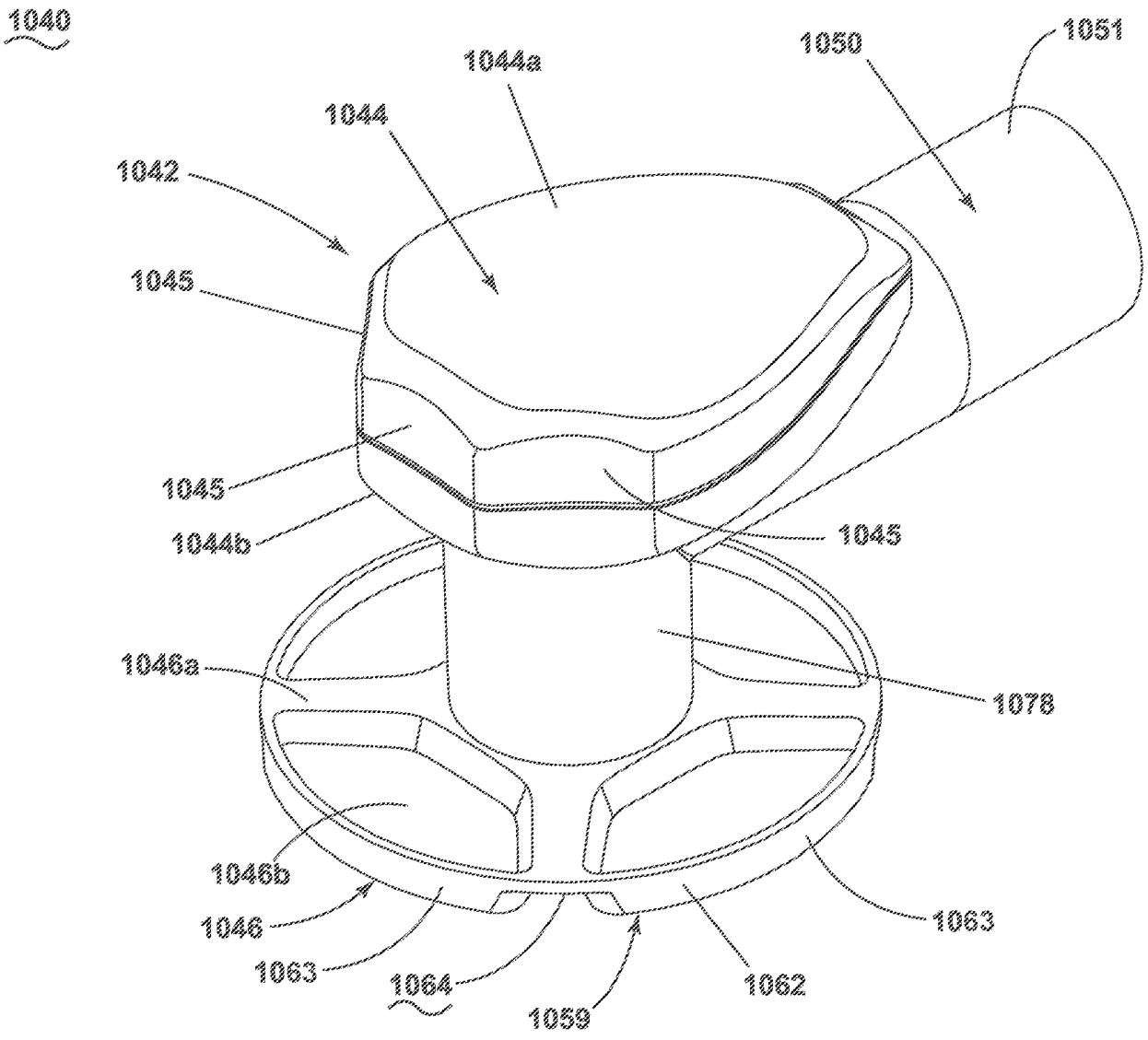
FIG. 14A is a perspective view of a vacuum cleaner accessory tool that can be utilized with the vacuum cleaner of FIG. 1 according to various aspects described herein.
Figure 14B:
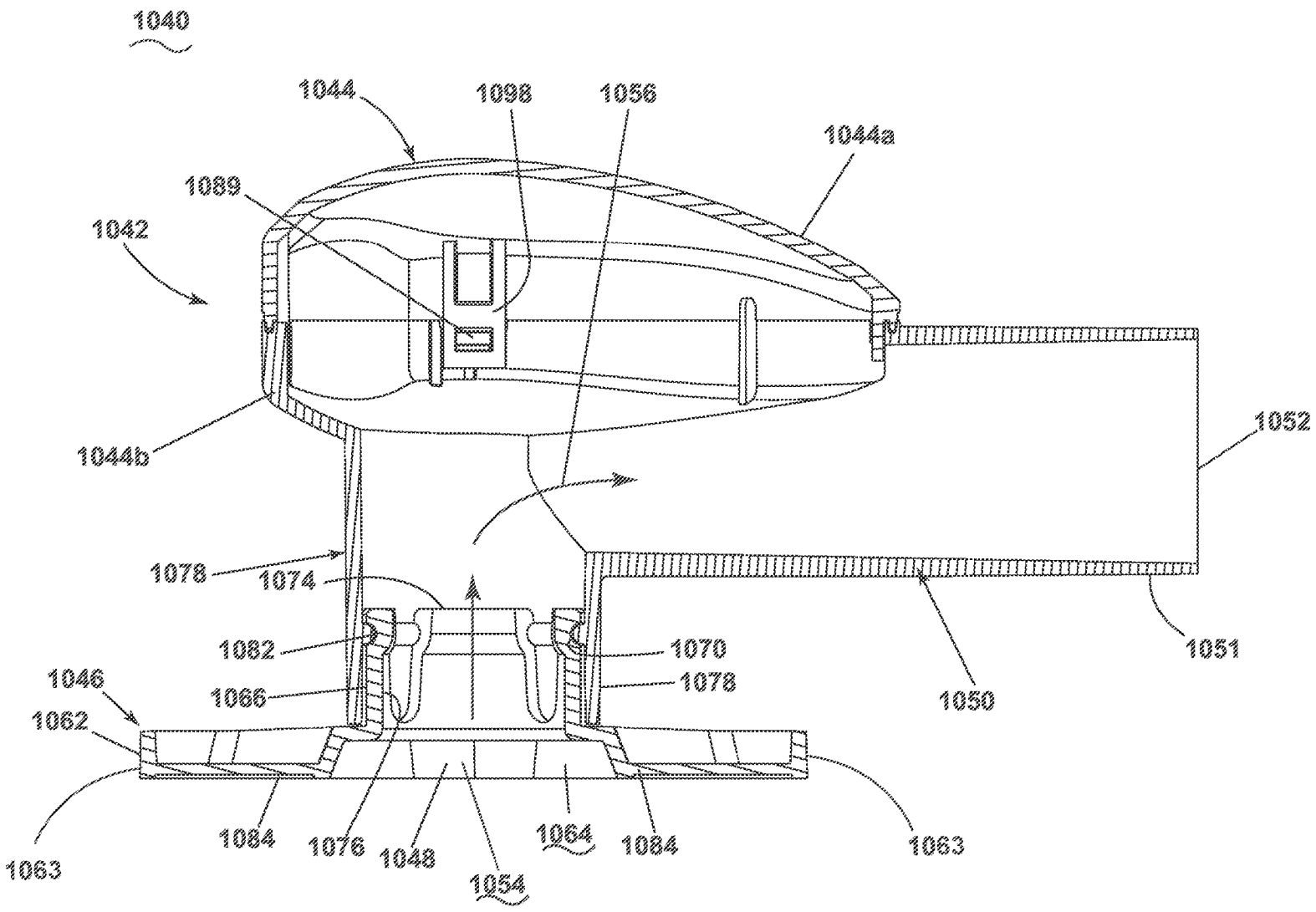
FIG. 14B is a cross-sectional view of the vacuum cleaner accessory tool of FIG. 14A.

FIGS. 14A and 14B illustrate another accessory tool 1040 that includes similar components as described for the accessory tool 40 and the accessory tool 140. Therefore, like parts will be identified with like numerals in the 1000 series with it being understood that the description of the like parts applies to the accessory tool 1040, unless otherwise noted. Like the accessory tool 140, the accessory tool 1040 includes a main housing assembly 1042 with both an upper housing 1044 and a lower housing 1046 with an underside 1059.

One difference is that the lower housing 1046 comprises a contoured lower body that resembles a contoured plate. The underside 1059 includes the set of channels 1064 leading to the suction nozzle inlet 1054 from an outer periphery 1062 and a plurality of hair collector supports 1063 with a channel 1064 located between each of two adjacent of the plurality of hair collector supports 1063. This creates a profile where the first hair collecting elements 1084 extend towards the surface to be cleaned and are separated by depressions created by the set of channels 1064. The upper side of the lower housing 1046 also includes a contoured body that is a relief of the profile on the underside 1059. More specifically, a ridge 1046*a* or a set of ridges 1046*a* are located on the upper side of the lower housing 1046 corresponding to the location of the set of channels 1064. Further still, pockets 1046*b* are formed on the upper side of the lower housing 1046 corresponding to where the hair collector supports 1063 project on the underside 1059. It has been found that the contouring of the lower housing 1046 or the formation of the lower housing 1046 as a contoured plate can provide increased rigidity and that the lower housing 1046 does not deflect or bend excessively during use when formed as such. Adding ribs, contours, or curved surfaces to a flat plate can increase the bending moment and structural rigidity compared to an entirely flat plate, for example.

Another difference is that the upper housing 1044 is illustrated as a two-part housing including a first portion 1044*a* and a second portion 1044*b*. The first portion 1044*a* and the second portion 1044*b* can be mounted or operably coupled in any suitable manner. As best seen in FIG. 14B a coupling assembly can include, by way of non-limiting example, a catch 1098 that extends from the first portion 1044*a* and receives a projection 1089 extending from the second portion 1044*b*. It will be understood that the upper housing 1044 can be formed in any suitable manner including have a single main housing assembly or a multi-piece main housing assembly that is secured together in any suitable fashion.

The upper housing is also illustrated as including a set of indentations 1045 at a forward portion or edge, which is generally opposite from the hose attachment 1050. The set of indentations 1045 extend on both the first portion 1044*a* and the second portion 1044*b* of the upper housing 1044 although it will be understood that this need not be the case and the indentations can be of any suitable length, shape, and profile. The indentations 1045 re configured to provide a grip detail on the upper housing 1044 that allows a user's fingers to have a firm, non-slip grip.

The accessory tool 1040 operates in the same manner as described above for the accessory tools 40 and 140 including having a rotational lower housing 1046 adapted to create a twisting and balling or accumulation of the removed hair such that the aggregated hair is moved towards the suction nozzle inlet 1054 and automatically removed during use via suction. The accessory tool 1040 removes pet hair with a side-to-side motion, front-to-back or top-to-bottom motion, as well as with a circular or semi-circular motion on the part of the user.

Any of the above described accessory tools can be utilized with a suction source, including of a cleaning apparatus such as the vacuum cleaner 10 as described, to form a system for cleaning and removing pet hair. Further still, it will be understood that any of the above described accessory tools or the systems can be utilized in a method for removing There are several advantages of the present disclosure arising from the various features of the apparatus described herein. For example, the aspects described above provide vacuum cleaner accessory tool with that provide improved hair removal from surfaces to be cleaned including upholstery and other soft surfaces. In use the vacuum cleaner accessory tool tends to ball up debris for easy ingestion such that the vacuum cleaner accessory tool tends to "self-clean" during operation. The channel(s) also allow for suction air flow relief to prevent the accessory tool 40 from auctioning down too tightly against the surface to be cleaned. This can be particularly important for cleaning soft surfaces to which pet hair becomes embedded such as upholstery. In this manner, the accessory tools have a hair removal system configured to collect hair from various surfaces to be cleaned, including soft surfaces such as upholstery, dog beds, pillows, and automobile interiors. The collected hair is gathered by the hair removal system and ingested via the vacuum cleaner.

While a "dry" vacuum cleaner has been illustrated herein, it is understood that any commonly known vacuum cleaner or surface cleaning appliance including a suction source is acceptable for use with the accessory tools described herein including an autonomous robot floor cleaner. For example, details of a suitable "wet" vacuum cleaner for use with the accessory tool are disclosed in commonly assigned U.S. Pat. No. 9,186,028 to White et al. and U.S. Pat. No. 6,279,196 to Kasen et al., which are incorporated herein by reference in their entirety. Furthermore, details of a suitable "autonomous robot floor cleaner" for use with the accessory tool are disclosed in commonly assigned U.S. patent application Ser. No. 15/705,781 to Scholten et al., which is incorporated herein by reference in its entirety.

To the extent not already described, the different features and structures of the various exemplary illustrations and explanations of the accessory tools may be used in combination with each other as desired. That one feature may not be illustrated in all of the exemplary illustrations and explanations is not meant to be construed that it cannot be, but is done for brevity of description. Thus, the various features of the different exemplary illustrations and explanations of the accessory tools may be mixed and matched as desired to form new accessory tools, whether or not the new accessory tools are expressly described. For example, while interchangeable plates have only been described with respect to one example it will be understood that they can be utilized with any of the described examples.

Further aspects of the disclosure are provided by the subject matter of the following clauses:

An accessory tool, comprising a main housing assembly defining an underside having an outer periphery; a suction nozzle provided on an interior portion of the underside; a conduit provided with the main housing assembly and adapted to be connected to a suction source remote from the main housing assembly, the suction source adapted for generating a working air flow from the suction nozzle through the main housing assembly to the conduit; and a set of hair collecting elements provided on the underside between the suction nozzle and the outer periphery, the set of hair collecting elements configured to create a balling or aggregating effect of removed hair from a surface to be cleaned during use to agglomerate the removed hair into a ball-shaped cluster and move the removed hair towards the suction nozzle.

The accessory tool of any preceding clause wherein the main housing assembly further comprises an upper housing and a lower housing that is at least one of freely rotatably coupled to the upper housing or indexably rotatably coupled to the upper housing.

The accessory tool of any preceding clause wherein the lower housing further comprises a first conduit and the upper housing further comprises a second conduit and wherein the first conduit is rotatably received within the second conduit or the second conduit is rotatably received within the first conduit.

The accessory tool of any preceding clause wherein one of the first conduit or the second conduit includes a flange and an other of the first conduit or the second conduit includes at least one interior recess that receives the flange.

The accessory tool of any preceding clause wherein the one of the first conduit or the second conduit includes a set of flexible fingers.

The accessory tool of any preceding clause wherein the set of flexible fingers are spaced about the one of the first conduit or the second conduit.

The accessory tool of any preceding clause wherein the flange is located on the set of flexible fingers.

The accessory tool of any preceding clause wherein the at least one interior recess is a series of discreet recesses.

The accessory tool of any preceding clause wherein the upper housing includes indentations at a forward end, opposite the conduit, the indentations adapted to form a grip for fingers of a user.

The accessory tool of any preceding clause wherein the upper housing is a two-piece body including a first portion and a second portion mounted together via a catch located on a first portion of the two-piece body and a latch, adapted to be received by the catch, on a second portion of the two-piece body.

The accessory tool of any preceding clause wherein the lower housing further comprises a contoured lower body with the underside having a plurality of hair collector supports that extend away from the upper housing and a channel located between two adjacent of the plurality of hair collector supports.

The accessory tool of any preceding clause wherein an upper side of the contoured lower body is a relief of a profile on the underside.

The accessory tool of any preceding clause wherein the underside includes a set of channels formed in the underside and extending from the outer periphery to the suction nozzle.

The accessory tool of any preceding clause wherein the set of hair collecting elements comprises a plurality of directional fabric hair collectors having unidirectional oriented fibers and wherein the unidirectional fibers of each of the plurality of directional fabric hair collectors is oriented towards at least one channel of the set of channels or the suction nozzle.

The accessory tool of any preceding clause further comprising an airflow pathway from the set of channels, through the suction nozzle and main housing assembly to the conduit, wherein hair is automatically ingested under suction provided by the suction source.

The accessory tool of any preceding clause wherein the underside includes a set of channels formed in the underside and extending from the outer periphery to the suction nozzle.

The accessory tool of any preceding clause wherein the set of hair collecting elements comprises a plurality of directional fabric hair collectors having unidirectional oriented fibers and wherein the unidirectional fibers of each of the plurality of directional fabric hair collectors is oriented towards at least one channel of the set of channels or the suction nozzle.

The accessory tool of any preceding clause wherein the underside has a domed profile that is sloped from the suction nozzle that is centrally located to the outer periphery.

The accessory tool of any preceding clause wherein the set of hair collecting elements comprises at least one of directional fabric or an elastomeric material.

An accessory tool, comprising a main housing assembly defining an underside having an outer periphery; a suction nozzle provided on a centralized portion of the underside; a set of channels formed in the underside and extending from the outer periphery to the suction nozzle; a conduit provided with the main housing assembly and adapted to be connected to a suction source remote from the main housing assembly, the suction source adapted for generating a working air flow from the suction nozzle through the main housing assembly to the conduit; a set of hair collecting elements provided on the underside between the suction nozzle and the outer periphery, the set of hair collecting elements configured to, during movement of the underside against a surface to be cleaned, liberate hair from the surface to be cleaned, collect the hair, ball up or accumulate the hair, and then release the hair to at least one of the set of channels of the suction nozzle to form accumulated released hair; and an airflow pathway from the set of channels, through the suction nozzle and main housing assembly to the conduit, wherein the accumulated released hair is automatically ingested under suction provided by the suction source.

While the innovation has been specifically described in connection with certain specific exemplary illustrations and explanations thereof, it is to be understood that this is by way of illustration and not of limitation. Reasonable variation and modification are possible with the scope of the foregoing disclosure and drawings without departing from the spirit of the innovation which, is defined in the appended claims. Hence, specific dimensions and other physical characteristics relating to the exemplary illustrations and explanations disclosed herein are not to be considered as limiting, unless the claims expressly state otherwise.

What is claimed is:

1. An accessory tool, comprising:

a housing assembly defining an underside, a suction nozzle provided at an interior portion of the underside, the housing assembly further comprising an outlet adapted to be connected to a suction source remote from the housing assembly, the suction source adapted for generating a working air flow from the suction nozzle through the housing assembly to the outlet, and a set of channels formed in the underside, wherein each channel of the set of channels extends away from a distal most portion of the underside to form a recess in the underside, and wherein each channel of the set of channels extends from the suction nozzle towards a periphery; and a set of hair collecting elements provided on the underside adjacent the set of channels, the set of hair collecting elements configured to create a balling or aggregating effect of removed hair from a surface to be cleaned during use to agglomerate the removed hair into a ball-shaped cluster and move the removed hair towards the set of channels and the suction nozzle.

2. The accessory tool of claim 1, wherein the underside has an outer periphery and the suction nozzle is centrally located.

3. The accessory tool of claim 2, wherein the set of channels extend between the suction nozzle and the outer periphery.

4. The accessory tool of claim 2, wherein the underside has a domed profile that is sloped from the suction nozzle to the outer periphery.

5. The accessory tool of claim 1, wherein the set of hair collecting elements comprises a plurality of directional fabric hair collectors having unidirectional oriented fibers.

6. The accessory tool of claim 5, wherein the unidirectional oriented fibers of at least one of the plurality of directional fabric hair collectors are oriented towards at least one channel of the set of channels or the suction nozzle.

7. The accessory tool of claim 1, wherein a subset of the set of hair collecting elements comprises an elastomeric material.

8. The accessory tool of claim 1, wherein the housing assembly comprises an upper housing and a lower housing and wherein the lower housing is configured to be freely moveable during operation with respect to the upper housing.

9. The accessory tool of claim 8, wherein the lower housing further comprises a contoured lower body with the underside having a plurality of hair collector supports that extend away from the upper housing and a channel of the set of channels is located between two adjacent of the plurality of hair collector supports.

10. The accessory tool of claim 9, wherein an upper side of the contoured lower body is a relief of a profile on the underside.

11. An accessory tool, comprising:

a housing assembly defining an underside, wherein the housing assembly comprises an upper housing having at least a portion adapted to be held by a user and a lower housing movably coupled to the upper housing and configured for free movement against a surface to be cleaned when the at least a portion of the upper housing is held by the user;

a suction nozzle provided at an interior portion of the underside;

an outlet provided with the housing assembly and adapted to be connected to a suction source remote from the housing assembly, the suction source adapted for generating a working air flow from the suction nozzle through the housing assembly to the outlet;

a set of channels formed in the underside, wherein each channel of the set of channels extends away from a distal most portion of the underside to form a recess in the underside, and wherein each channel of the set of channels extends from the suction nozzle towards a periphery; and a set of hair collecting elements provided on the underside adjacent the set of channels, the set of hair collecting elements configured to create a balling or aggregating effect of removed hair from a surface to be cleaned during use to agglomerate the removed hair into a ball-shaped cluster and move the removed hair towards the suction nozzle via the set of channels.

12. The accessory tool of claim 11, wherein the lower housing is configured for free rotation against the surface to be cleaned when the at least a portion of the upper housing is held by the user and moved along the surface to be cleaned.

13. The accessory tool of claim 11, wherein the lower housing further comprises a first conduit and the upper housing further comprises a second conduit and wherein the first conduit is rotatably received within the second conduit or the second conduit is rotatably received within the first conduit and the working air flow passes through both the first conduit and the second conduit.

14. The accessory tool of claim 13, wherein one of the first conduit or the second conduit includes a flange and an other of the first conduit or the second conduit includes at least one interior recess that receives the flange.

15. The accessory tool of claim 13, wherein the one of the first conduit or the second conduit includes a set of flexible fingers and an other of the first conduit or the second conduit includes at least one interior recess that receives the set of flexible fingers.

16. The accessory tool of claim 15, wherein the set of flexible fingers are spaced about the one of the first conduit or the second conduit.

17. The accessory tool of claim 15, wherein a flange is located on the set of flexible fingers.

18. The accessory tool of claim 13, wherein the upper housing includes indentations at a forward end, opposite the second conduit, the indentations adapted to form a grip for fingers of the user.

19. The accessory tool of claim 11, wherein the upper housing is a two-piece body including a first portion and a second portion mounted together via a catch located on the first portion of the two-piece body and a latch, adapted to be received by the catch, on the second portion of the two-piece body.

20. The accessory tool of claim 11, wherein the set of hair collecting elements comprises a plurality of directional fabric hair collectors having unidirectional oriented fibers, and further wherein the unidirectional oriented fibers of each of the plurality of directional fabric hair collectors is oriented towards at least one channel of the set of channels or the suction nozzle.

* * * * *